US009559459B2

(12) United States Patent
Jozwik et al.

(10) Patent No.: US 9,559,459 B2
(45) Date of Patent: Jan. 31, 2017

(54) PUSH-LOCK ELECTRICAL CONNECTOR

(71) Applicant: Woodhead Industries, Inc., Lisle, IL (US)

(72) Inventors: Keith A. Jozwik, Lindenhurst, IL (US); Joseph F. Murphy, Highland Park, IL (US)

(73) Assignee: Woodhead Industries, Inc., Lisle, IL (US)

( * ) Notice: Subject to any disclaimer, the term of this patent is extended or adjusted under 35 U.S.C. 154(b) by 0 days.

(21) Appl. No.: 14/829,803

(22) Filed: Aug. 19, 2015

(65) Prior Publication Data

US 2016/0190742 A1 Jun. 30, 2016

Related U.S. Application Data

(63) Continuation-in-part of application No. 14/057,614, filed on Oct. 18, 2013, now Pat. No. 9,142,914.

(51) Int. Cl.

| | |
|---|---|
| ***H01R 13/52*** | (2006.01) |
| ***H01R 13/627*** | (2006.01) |
| ***H01R 13/622*** | (2006.01) |
| *H01R 13/6583* | (2011.01) |

(52) U.S. Cl.

CPC ..... *H01R 13/6273* (2013.01); *H01R 13/622* (2013.01); *H01R 13/5202* (2013.01); *H01R 13/6583* (2013.01)

(58) Field of Classification Search

CPC ..... H01R 13/5221; H01R 13/52; H01R 33/95; H01R 13/22; H01R 33/18

USPC ..... 439/271, 587, 281, 732

See application file for complete search history.

(56) References Cited

U.S. PATENT DOCUMENTS

| | | | | |
|---|---|---|---|---|
| 6,280,229 | B1 | 8/2001 | Harting et al. | |
| 6,749,454 | B2 | 6/2004 | Schmidt et al. | |
| 6,884,105 | B2 | 4/2005 | Turck et al. | |
| 6,957,972 | B2 | 10/2005 | Starke et al. | |
| 6,979,225 | B2 | 12/2005 | Solano | |
| 7,182,617 | B1 * | 2/2007 | Cairns | G02B 6/3816 439/271 |
| 7,238,047 | B2 | 7/2007 | Saettele et al. | |
| 7,364,450 | B2 | 4/2008 | Hafner et al. | |

(Continued)

*Primary Examiner* — Abdullah Riyami
*Assistant Examiner* — Thang Nguyen
(74) *Attorney, Agent, or Firm* — Clarence R. Moon

(57) ABSTRACT

An inline multi-pin connector includes cylindrical male and female connector members which are electrically connected together by pushing the two members together end-to-end. Either the male or the female connector member has a metal cylinder disposed about its conductive pins or sockets, which are adapted for mutual engagement, while the other connector member is provided with inner threads. The metal cylinder includes plural resilient, spaced arms, or tabs, disposed about its outer periphery and urged radially outward and into engagement with the other member's threads to connect the two connector members. Coaxial seals are disposed between and in contact with the two members as is a compressible O-ring seal. The outer periphery of the inner member's cylindrical insulator is provided with alternating peaks and valleys, while the other member's metal cylinder is provided with inwardly extending resilient arms which are adapted for positioning within a respective facing valley to prevent vibration-induced disconnection.

27 Claims, 34 Drawing Sheets

(56) References Cited

U.S. PATENT DOCUMENTS

| | | | | |
|---|---|---|---|---|
| 7,503,788 | B2 * | 3/2009 | Holterhoff | H01R 13/622 439/256 |
| D626,068 | S | 10/2010 | Geifers et al. | |
| D626,506 | S | 11/2010 | Geifers et al. | |
| 7,850,472 | B2 * | 12/2010 | Friedrich | H01R 13/506 439/256 |
| 7,976,341 | B2 | 7/2011 | Osenberg | |
| 8,007,302 | B2 | 8/2011 | Kleinke | |
| 8,192,218 | B2 * | 6/2012 | Sasaki | H01R 13/625 439/320 |
| 8,235,741 | B2 * | 8/2012 | Schulze | H01R 13/5219 439/339 |
| 2004/0029443 | A1 * | 2/2004 | Quadir | H01B 17/306 439/587 |
| 2006/0051999 | A1 | 3/2006 | Allemann et al. | |
| 2006/0240710 | A1 * | 10/2006 | Kato | H01R 13/5205 439/587 |
| 2007/0155237 | A1 * | 7/2007 | Cairns | H01R 13/521 439/587 |
| 2007/0293076 | A1 | 12/2007 | Fehling et al. | |
| 2009/0264003 | A1 * | 10/2009 | Hertzler | H01R 13/5219 439/299 |
| 2009/0269958 | A1 | 10/2009 | Fujiwara et al. | |
| 2009/0269981 | A1 | 10/2009 | Haruna et al. | |
| 2010/0035457 | A1 | 2/2010 | Holliday | |
| 2012/0252265 | A1 * | 10/2012 | Wild | H01R 9/0521 439/578 |

* cited by examiner

PUSH-LOCK ELECTRICAL CONNECTOR

CROSS REFERENCE TO RELATED APPLICATION

This application is a continuation-in-part of U.S. patent application Ser. No. 14/057,614 filed on Oct. 18, 2013. The present application repeats a substantial portion of the aforementioned prior patent application, and adds and claims additional disclosure not presented in the prior application. Since this application names the inventor, or at least one joint inventor named in the prior application, it constitutes a continuation-in-part of the prior application. Applicant desires to claim the benefit of the earlier filing date of the aforementioned prior application.

FIELD OF THE INVENTION

This invention relates generally to quick connect/disconnect, multi-pin electrical connectors, and is particularly directed to a push-lock electrical connector incorporating metal threads, a high strength, secure seal, and an anti-vibration capability.

BACKGROUND OF THE INVENTION

Inline electrical connectors tend to be of two basic types: the screw-type connector or the bayonet-type connector. The screw-type connector incorporates mating threads on the plug and socket portions of the connector and requires rotation of one or the other to connect the sets of electrical cables together in a sealed manner. Connection and disconnection are labor-intensive and require the application of a predetermined fastening torque to achieve an environmental seal or overcoming of this torque in disconnecting the pair of connector members. The fastening torque may undergo unintended loosening when the connector is subject to vibration forces resulting in loss of the connector seal and interruption of the pin and socket connections. Connection and disconnection of the two threaded connector members is also relatively slow and time consuming. The bayonet-type connection, on the other hand, is easily and quickly formed or disconnected. However, the coupled members in a bayonet connection are more easily separated and the connection broken than in a threaded connector. In addition, the bayonet connection is less adapted for the formation of high strength, tight seals than the threaded connection. Finally, the threaded and bayonet approaches are mutually exclusive, as one cannot be connected to the other which, in some cases, is inefficient and wasteful.

Recent efforts in this area have given rise to the use of segmented thread arrangements on each of the two connecting members which can be joined by pushing one connecting member onto the other in an axial direction, followed by rotation of one or both of the connecting members to place their respective thread arrangements in mutual engagement. Thus, this approach includes pushing the two connector members together as in the bayonet approach, followed by relative rotation between the two connector members to provide their threaded engagement. This combined approach does not afford all of the advantages of both approaches taken individually. For example, rotation of one or both of the connecting members is required for connection, while the integrity and strength of the connection is limited by the partial thread arrays that must be on both connecting members. In addition, the connector's seal is limited because of the hand torque requirement to achieve the environmental seal. One approach in this area utilizes plastic segmented threads that wear after a few couplings and uncouplings of the pair of connector members or lose their ability to "spring back" because the elastic limit of the plastic has been reached. The present invention addresses and overcomes these limitations by providing a push-type connection resulting in full thread engagement between the two connecting members that use a standard thread.

SUMMARY OF THE INVENTION

Accordingly, it is an object of the present invention to provide a push-type electrical connector with a threaded connection coupling the two connector members.

It is another object of the present invention to provide a tightly sealed, closed compartment for the plural conductive elements in an inline electrical connector.

Yet another object of the present invention is to provide a vibration-resistant connection between the male and female connecting members of a push-type electrical connector.

A further object is to provide quick and easy push-type engagement between the male and female connecting members of an inline, multi-pin electrical connector, while securely maintaining the two connecting members coupled together by means of a threaded type connecting arrangement.

A still further object of the present invention is to provide a sealed compartment for the contact elements of an electrical connector where the strength of the seal can be easily achieved regardless of the torque used to mate the connector members.

This invention is directed to an inline electrical connector adapted for quick, locked connection by merely pushing the male and female connecting members together in establishing a threaded, sealed connection between the two connecting members. The push-lock electrical connector further includes an anti-vibration feature to prevent relative rotational movement between the male and female connecting members to ensure that electrical continuity is maintained. The push-lock electrical connector also incorporates metal threads rather than plastic threads to increase reliability and connector operating lifetime. The push-lock connector is fully compatible with traditional threaded electrical connectors such as of the M12 threaded type.

An additional related embodiment of this invention contemplates an electrical connector having mating male and female connecting members, where either connecting member includes an elastic member which allows that connecting member to receive and to securely couple to the other connecting member in a secure, electrically insulated and electromagnetically shielded manner. In one embodiment, the male connector member includes a cylindrical male insulator insert having an outer peripheral lateral wall forming an open cylindrical space within which are plural elongated, spaced conductive pins. The mating female connecting member includes plural spaced sockets each adapted to receive a respective connector pin when the female connecting member is inserted in male member's open cylindrical space in establishing electrical contact between the two connector members. The lateral wall of the male member forming the open cylindrical space which is adapted to receive the female connector member in a tight-fitting manner includes at least one slot therein extending longitudinally from the male member's outer end inwardly Disposed on the inner surface of the male member's lateral wall and spanning the at least one slot therein is a thin layer of an elastic insulating material, such as comprised of silicone, which allows for outward lateral expansion of the male member's lateral wall, permitting the male member to receive and engage in a tight-fitting manner mating female members having a range of diameters. The stretchable material may also be incorporated in the female connecting member to accommodate a range of diameter sizes and tolerances in mating male members, by elastically undergoing radially inward compression when a conductive pin-bearing male connector member is inserted over the female member's socket-bearing end portion. In the latter embodiment, the elastic layer may be disposed about the female connector member or the female connector member may be substantially comprised of the elastic electrically insulating material. In one embodiment, rendering the elastic insulating layer conductive allows the layer to also function as an electromagnetic interference (EMI) shield in the electrical connector.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
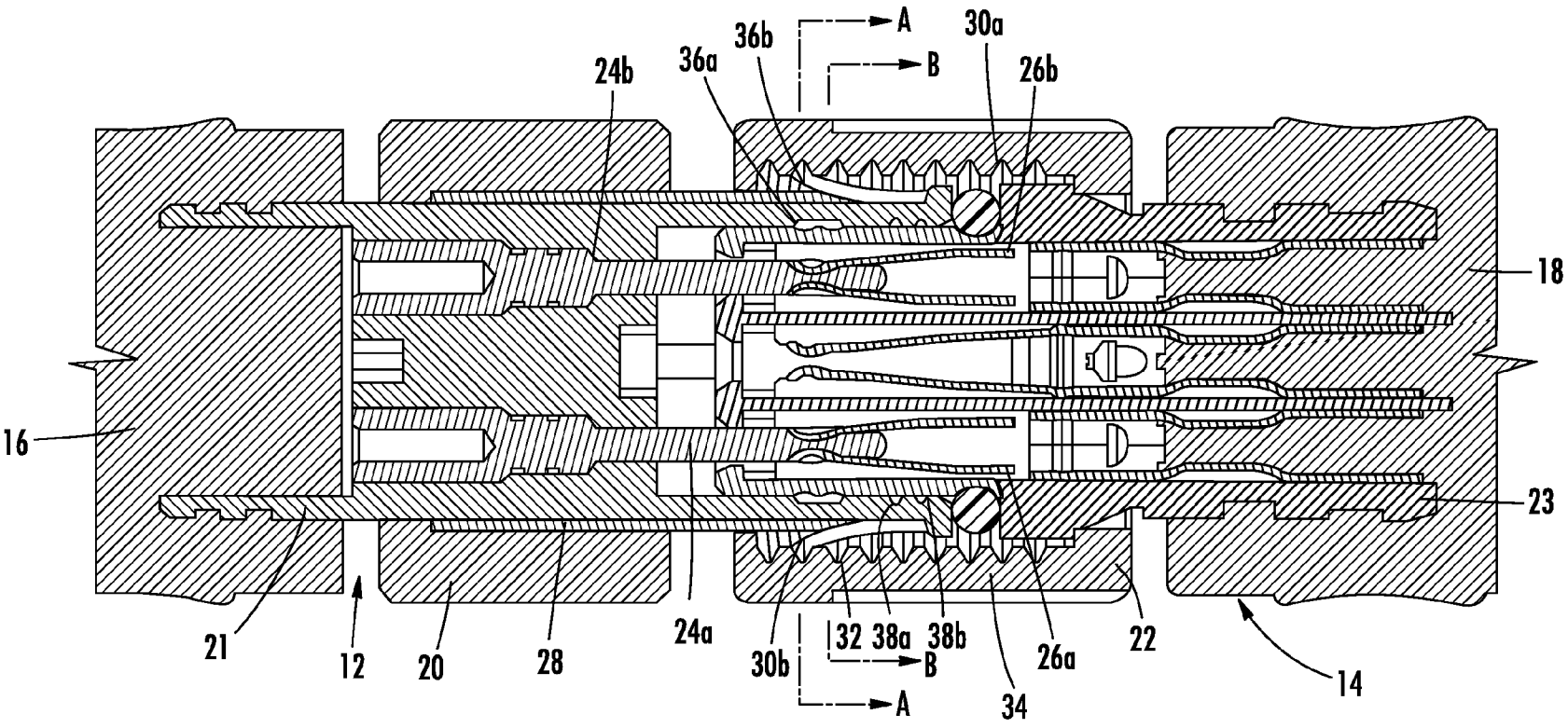
FIG. 1 is a longitudinal sectional view of the push-lock electrical connector of the present invention mated, or engaged, with a traditional M12 threaded type electrical connector.

With reference to the above described figures, the push-lock electrical connector 10 of the present invention will now be described in detail. Push-lock electrical connector 10 includes a male connecting member 12 and a female connecting member 14, with the male connecting member including plural spaced male pins 24*a*-24*d* and the female connecting member 14 including plural spaced sockets 26*a*-26*d*, each adapted for receiving a respective male pin in a tight-fitting manner as shown in FIG. 1. Male connecting member 12 further includes a male overmold 16 coupled on an end thereof to a male insulator insert 21. Plural electrical conductors, or wires, (not shown for simplicity) are disposed in the first male overmold 16, with each of the wires connected to a respective one of the male pins 24*a*-24*d*. Each of the male pins 24*a*-24*d* is inserted through a respective slot within the male insulator 21 and extends into an open recess in the outer end of the male insulator. Coaxially aligned with and disposed between adjacent portions of an outer male coupling sleeve 20 and the inner male insulator insert 21 is a metal cylinder 28.

Female connecting member 14 includes a female overmold 18 attached on an end portion thereof to a female insulator insert 23. Disposed about and engaging an outer surface of the female insulator insert 23 is a female outer coupling sleeve 22 having threads 32 located on an inner surface thereof. Plural spaced female sockets 26*a*-26*d* are attached to an end of the female overmold 18 and are disposed in and extend through respective slots within the female insulator insert 23. Electrical leads, or wires, which are not shown in the figure for simplicity, are each connected to a respective one of the female sockets 26*a*-26*d*. Each of the female sockets 26*a*-26*d* is adapted to receive in tight-fitting engagement a respective one of the male pins 24*a*-24*d* to establish electrical continuity between the plural leads in the male connecting member 12 and the plural leads in the female connecting member 14. An O-ring 34 is disposed between and in contact with female insulator 23 and an end portion of the male insulator 21 to establish a sealed environment for the male pins and female sockets. Male and female insulator inserts 21 and 22 are preferably comprised of plastic, or another material having high dielectric properties.

In one illustrated embodiment, metal cylinder 28 is shown as having four resilient tabs 30*a*-30*d* disposed in a spaced manner about its outer periphery, although the present invention is not limited to this number of resilient tabs on the metal cylinder. Each of the four resilient tabs 30*a*-30*d* is formed by stamping or otherwise deforming the lateral wall of the metal cylinder 28, with each of the resilient tabs extending outwardly in a direction away from the open end portion of male connecting member 12. The orientation and the resilience of each of the four tabs 30*a*-30*d* allows the male connecting member 12 to be inserted, or "pushed", into the female connecting member 14, whereupon the distal ends of each of the four resilient tabs 30*a*-30*d* engage the inner threads 32 of the female outer coupling sleeve 22 as shown in FIG. 1. With the distal ends of each of the four resilient tabs 30*a*-30*d* engaging a portion of the inner threads 32 of the female outer coupling sleeve 22, the male and female connecting members 12, 14 are securely coupled together. The resilience of the tabs 30*a*-30*d* allows their respective distal ends to be displaced radially inwardly upon contacting the crest portions of the threads, with the resilience of the tabs then urging the distal end of each of the tabs radially outward so as to engage an immediately adjacent thread portion during insertion of the male connecting member 12 into the female connecting member 14. Male connecting member 12 is fully inserted in female connecting member 14 when the distal end portion of male insulator 21 engages O-ring 34 to form the above-described seal between the two connecting members for sealing the space in which the male pins 24*a*-24*d* and the female sockets 26*a*-26*d* are disposed. Once inserted into the female connecting member 14 and into engagement with threads 32, it may be necessary to rotate the male connecting member 12 containing the resilient tabs 30*a*-30*d* a partial turn either clockwise or counterclockwise to ensure that the distal ends of the tabs engage inner portions of the threads and not an outer edge of the threads to ensure secure engagement between the resilient tabs and the threads.

Figure 5:
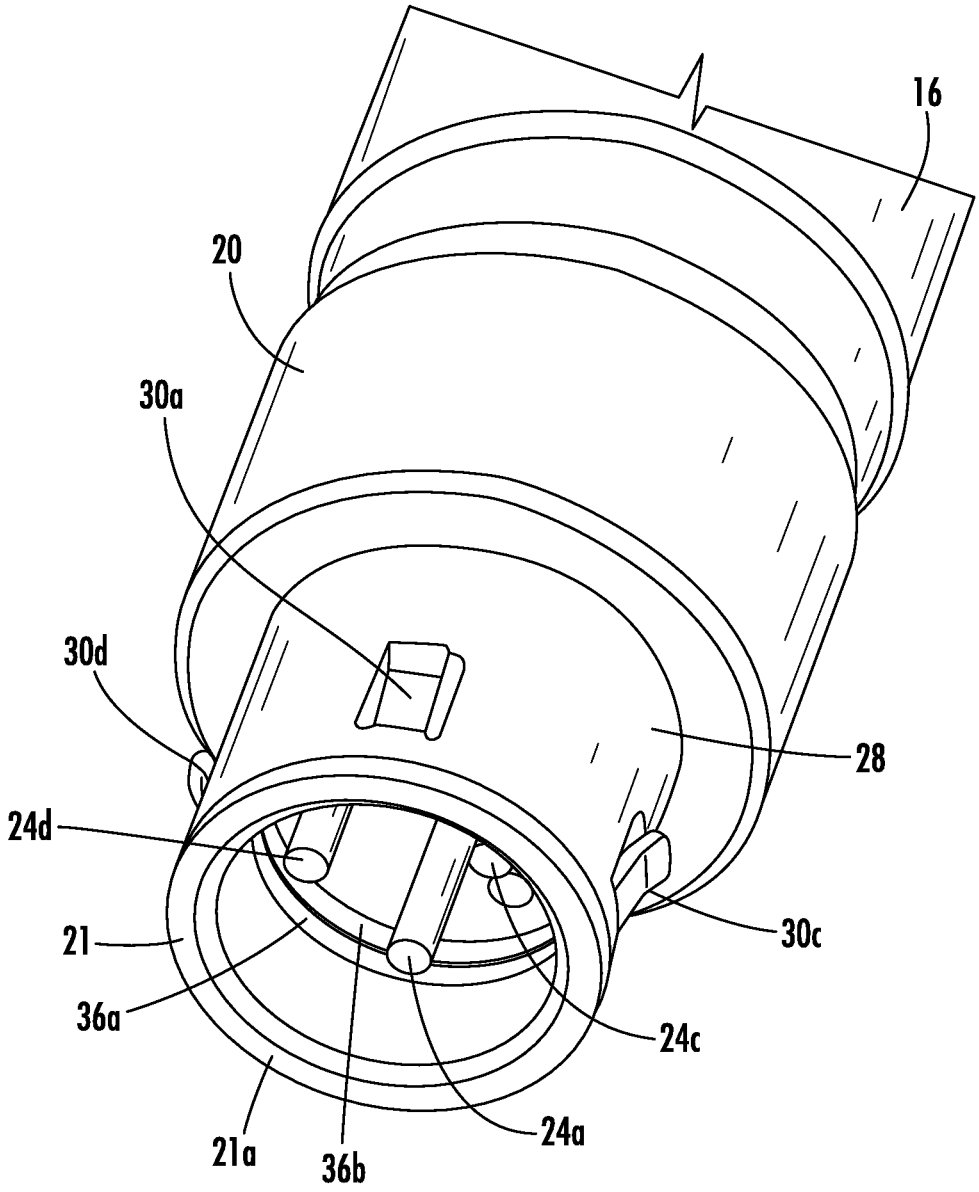
FIGS. 5 and 6 are perspective views of the end portion of the male connecting member of the push-lock electrical connector.
Figure 6:
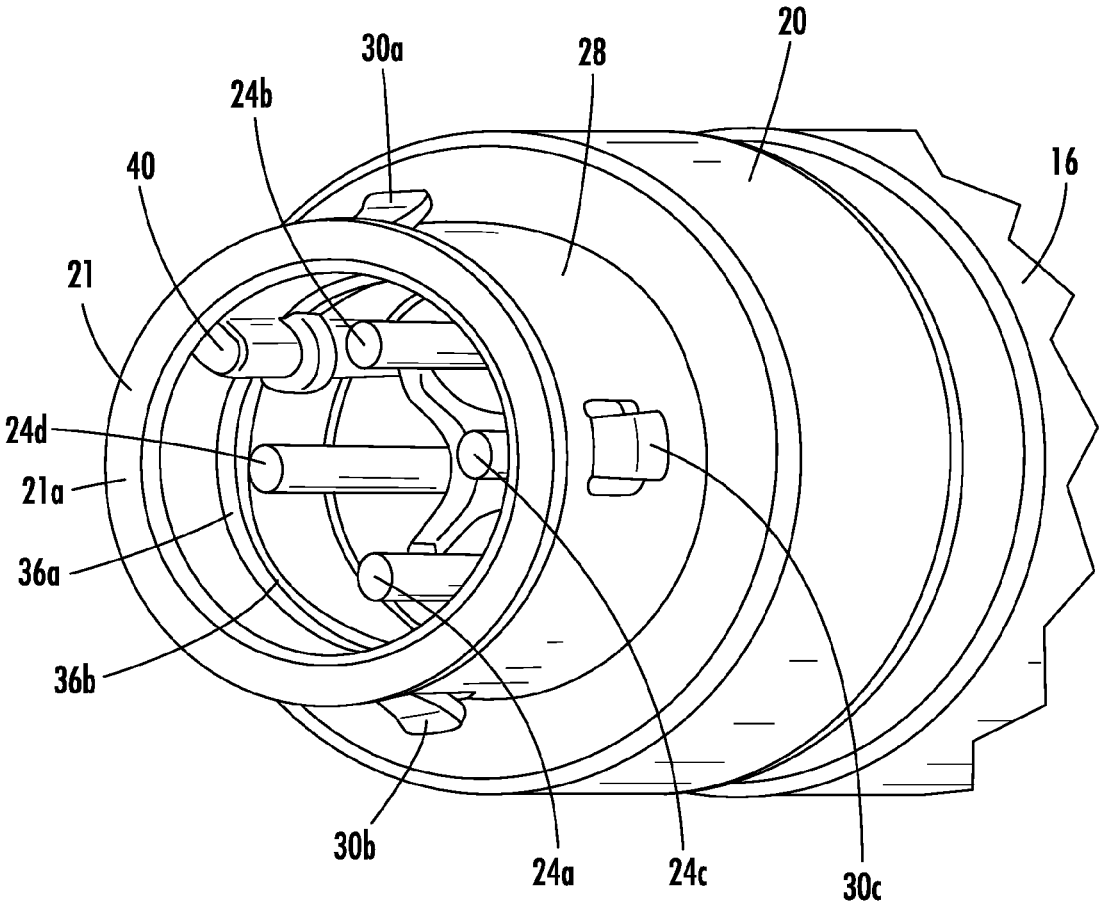
Figure 7:
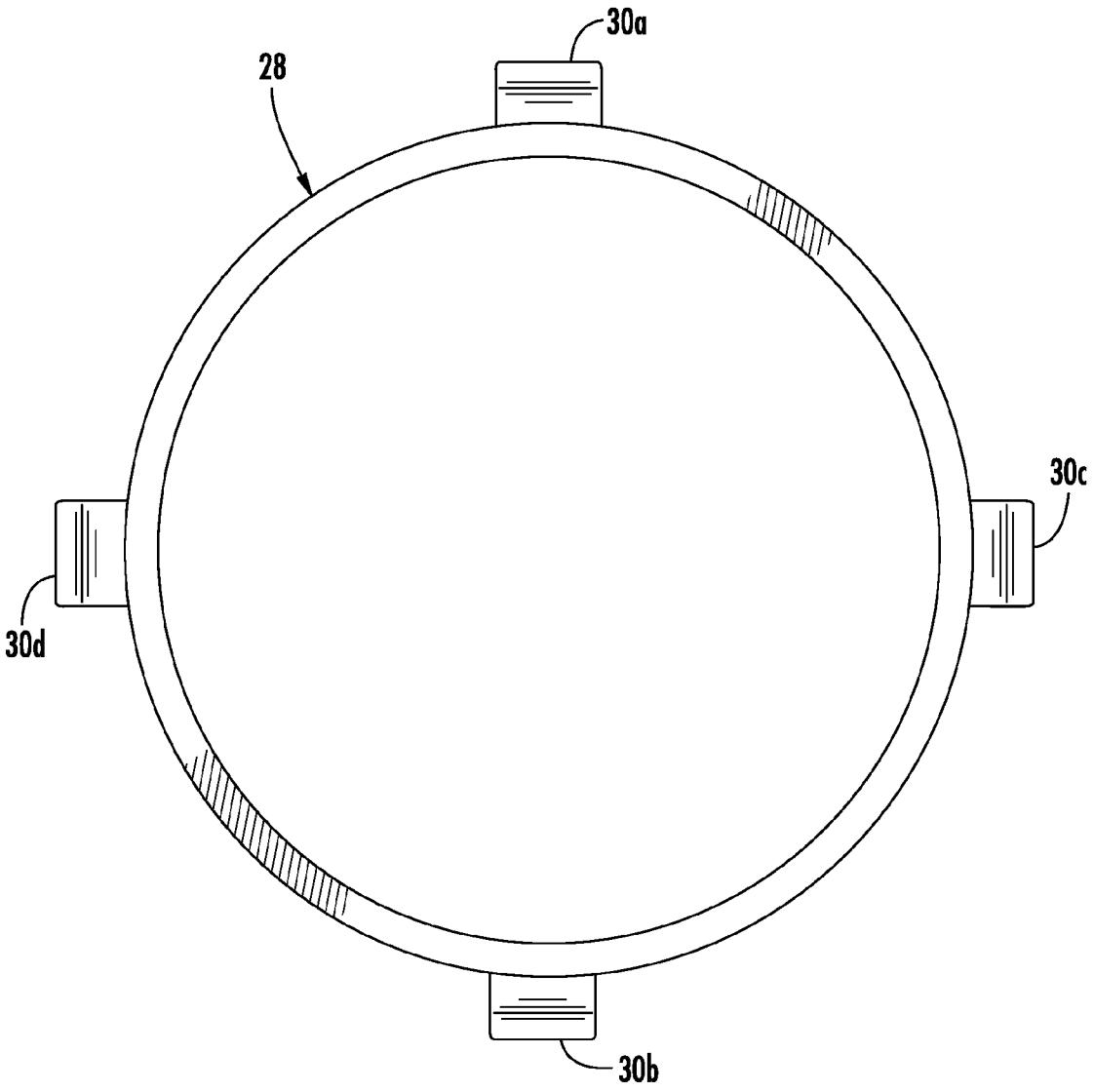
FIGS. 7 and 8 are respectively end-on and side elevation views of the metal cylinder with resilient tabs incorporated in the inventive push-lock electrical connector.
Figure 8:
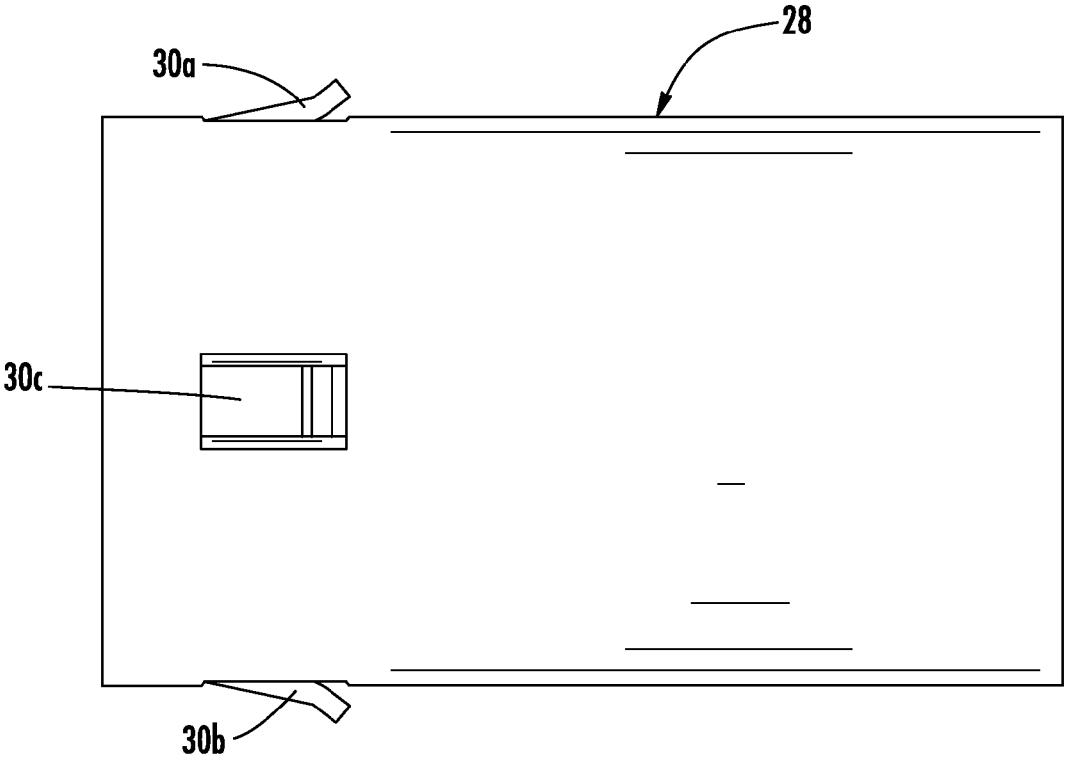

Disposed on the inner surface of male insulator 21 are the aforementioned first and second seals 36*a* and 36*b* as shown in FIGS. 1, 5 and 6. Seals 36*a* and 36*b* also provide a seal for the space within the push-lock electrical connector 10 in which the connected male pins 24*a*-24*d* and female sockets 26*a*-26*d* are located. In fact, the first and second seals 36*a*, 36*b* eliminate the need for O-ring 34 in providing a sealed environment for the connected male pins 24*a*-24*d* and female sockets 26*a*-26*d*. While the aforementioned seal is described as formed by first and second seals 36*a*, 36*b* disposed on an inner surface of male insulator 21, the aforementioned seals can also be positioned on the outer surface of the female insulator 23 so as to engage an inner surface of male insulator 21 in forming a seal. Similarly, while two seals 36*a*, 36*b* are disclosed, the invention is not limited to two seals. For example, a higher number of seals could be provided between the male insulator 21 and female insulator 23 to increase the strength of the seal. Conversely, a single seal could be used where the application calls for a seal of reduced strength.

While the illustrated and described embodiment of the invention includes a metal cylinder 28 with resilient tabs 30*a*-30*d* disposed in the male connecting member 12 for engaging threads 32 in the female outer coupling sleeve 22, the metal cylinder could alternatively be positioned within the female connecting member 14 for engaging inner threads provided for on the male insulator 21. The present invention also contemplates the use of a pair of metal cylinders each having a respective set of resilient tabs, with one metal cylinder disposed within the male connecting member 12 and the other metal cylinder disposed within the female connecting member 14. The metal cylinder disposed within the male connecting member 12 would securely engage an inner portion of the female connecting member 14, while the metal cylinder in the female connecting member would securely engage an inner portion of the male connecting member. On the two metal cylinders could be disposed in mutual engagement to provide a secure, sealed coupling between the male and female connecting members 12, 14. In this latter embodiment, neither the male connecting member 12 nor the female connecting member 14 would necessarily include inner threads.

Figure 9:
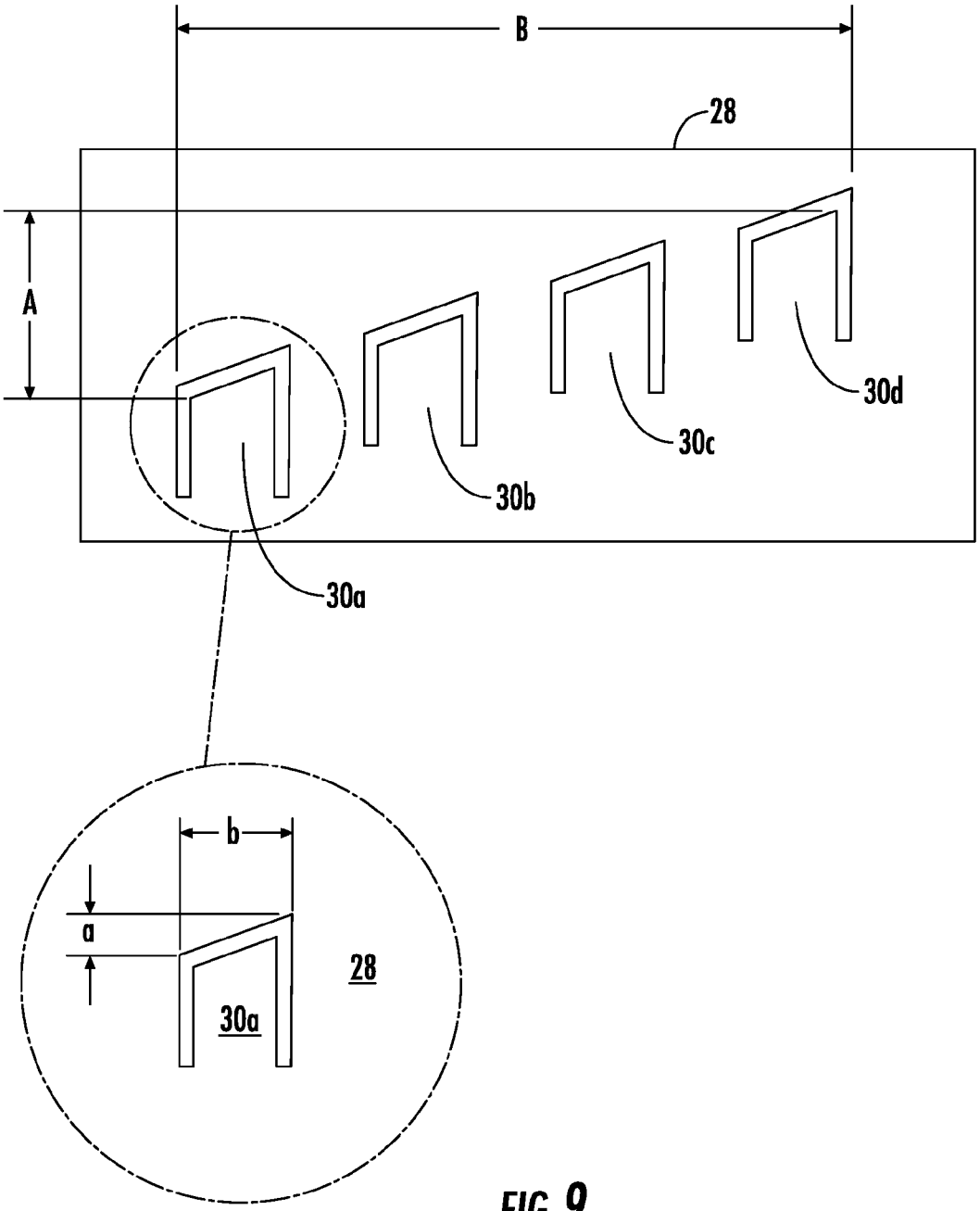
FIG. 9 is a plan view of the metal cylinder with resilient tabs incorporated in the inventive push-lock electrical connector prior to being formed into a cylindrical shape.

Referring to FIG. 9, there is shown a plan view of metal cylinder 28 in a flat configuration which is the form of the metal cylinder as originally manufactured. Metal cylinder 28 is then subjected to a rolling process to provide its cylindrical shape. Formed within metal cylinder 28 are the aforementioned four resilient tabs 30*a*-30*d*. Because the resilient tabs 30*a*-30*d* each form a portion of a thread and are adapted for engaging a threaded surface characterized with a given pitch, or slope, the pitch of the array of the four resilient tabs is given by the ratio A/B. Similarly, the pitch of each of the individual resilient tabs is given by the ratio a/b as shown in the encircled portion of FIG. 9. In the present case, the pitch of the array of the four resilient tabs and the pitch of the individual resilient tabs are equal, or A/B=a/b.

Figure 10:
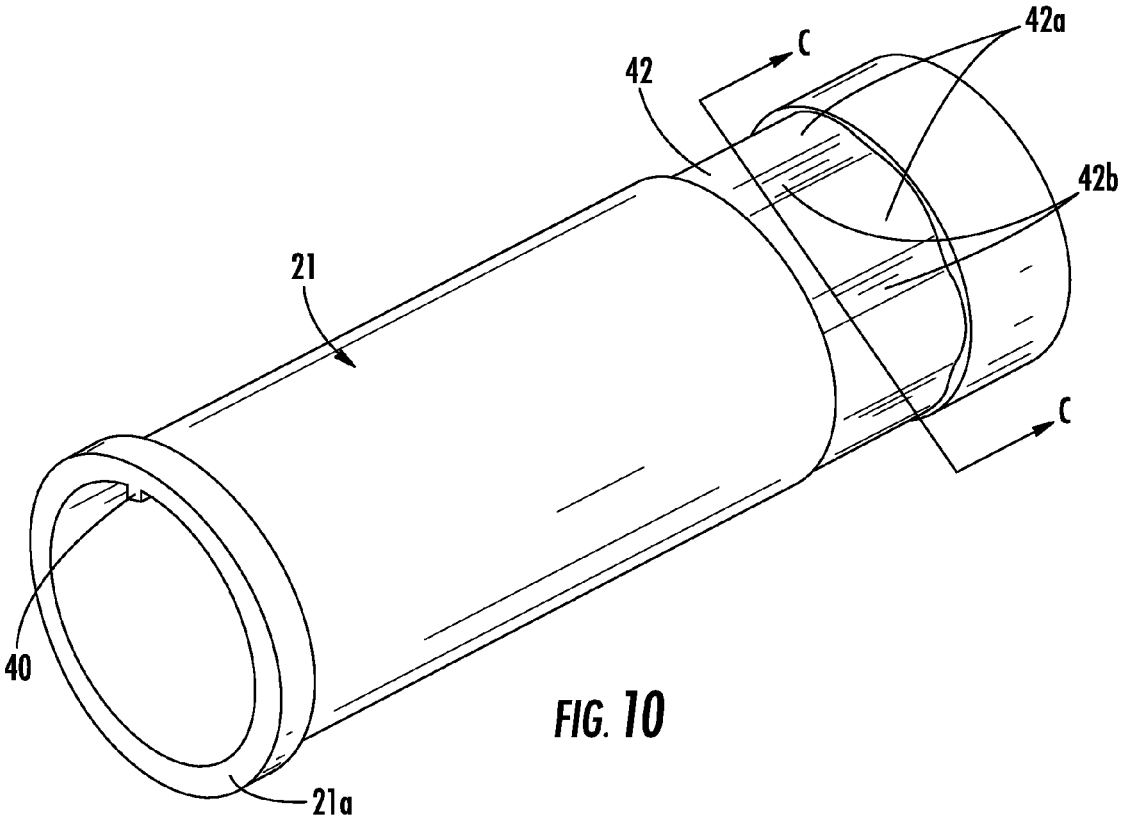
FIGS. 10 and 11 are respectively perspective and transverse sectional views of the male insulator incorporated in the push-lock electrical connector of the present invention, where the sectional view of FIG. 11 is taken along site line c-c in FIG. 10.
Figure 11:
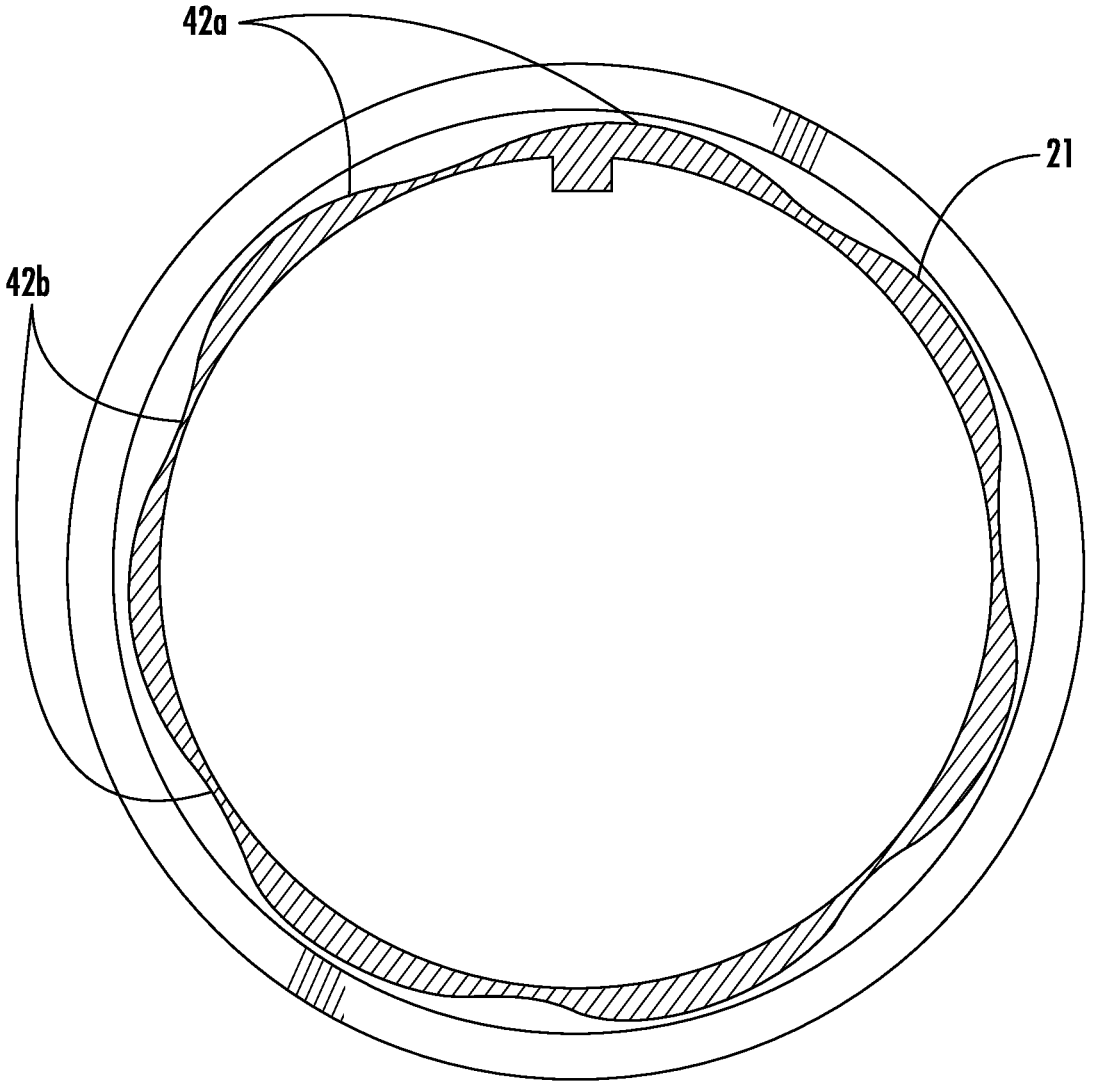

Referring to FIG. 10, there is shown a perspective view of male insulator insert 21. FIG. 11 illustrates a sectional view of the male insulator insert 21 taken along site line C-C in FIG. 10. Along site line C-C, the male insulator insert 21 has an undulating outer surface 42 having a series of alternating upraised portions, or peaks, 42*a* and sunken portions, or valleys, 42*b*.

Figure 12:
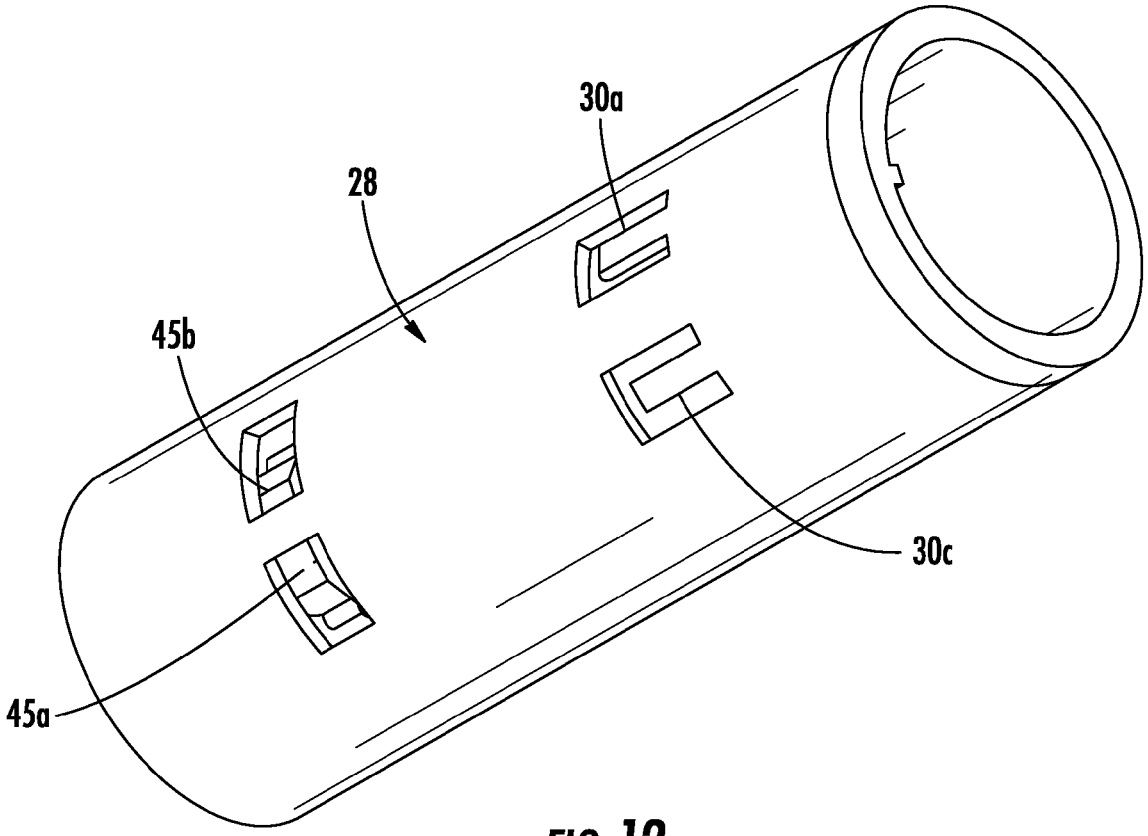
FIG. 12 is a perspective view of metal cylinder with anti-vibration resilient tabs incorporated in the inventive push-lock electrical connector.
Figure 13:
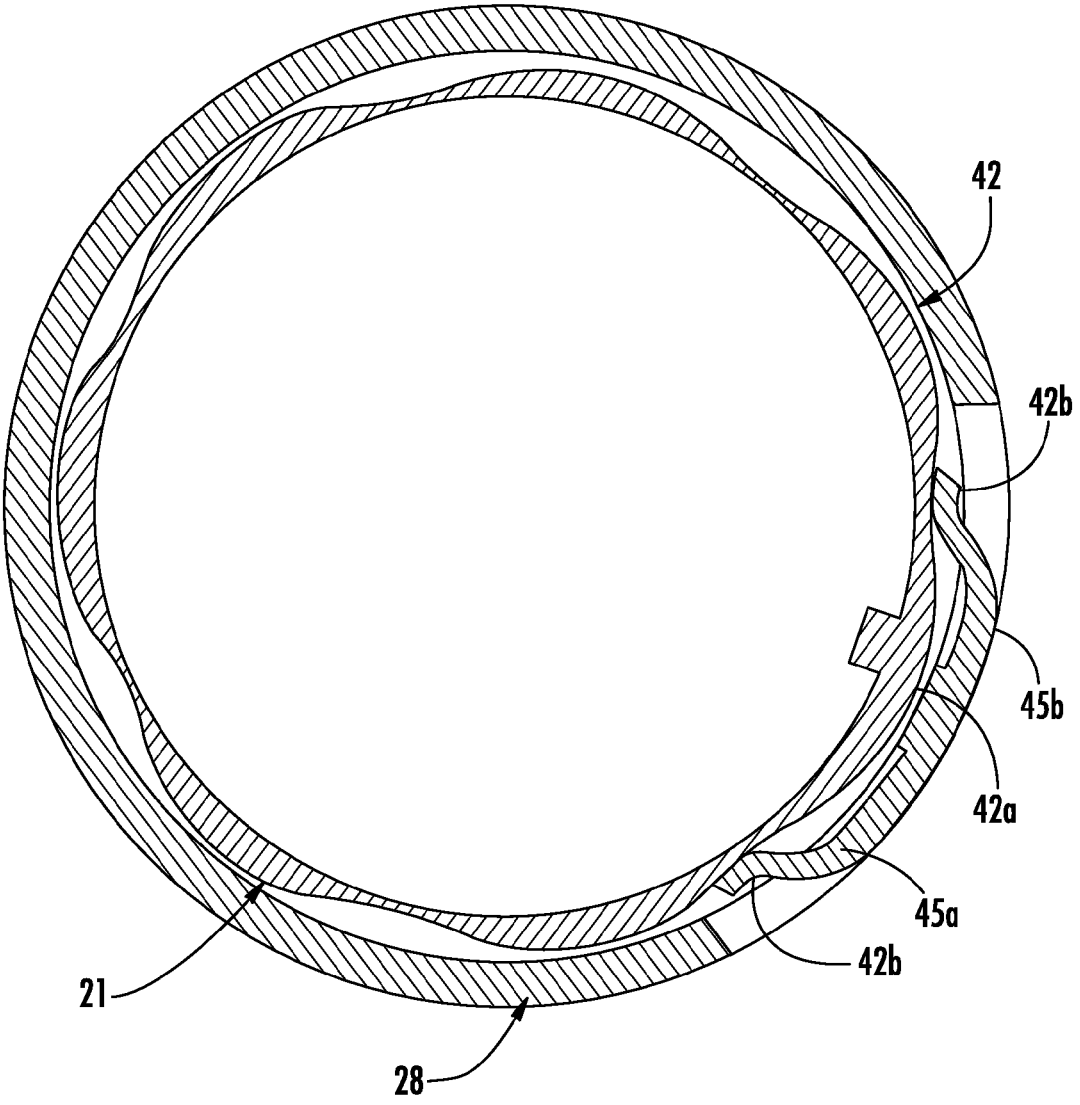
FIG. 13 is a transverse sectional view of the combination of the outer metal cylinder with resilient tabs taken along site line D-D in FIG. 12 and the inner male insulator taken along site line C-C in FIG. 10, which combination provides anti-vibration protection in the push-lock electrical connector of the present invention.

FIG. 12 is a perspective view of metal cylinder 28 illustrating a pair of resilient tabs 30*a* and 30*c* disposed in a spaced manner about the outer periphery of the metal cylinder. Also formed in the lateral surface of metal cylinder 28 are first and second inwardly extending arms 45*a* and 45*b*. Arms 45*a* and 45*b* may be formed in metal cylinder 28 by conventional means such as by stamping similar to the manner in which the resilient tabs 30*a*-30*d* are formed in the lateral wall of the metal cylinder. The distal ends of the inwardly extending resilient arms 45*a* and 45*b* are adapted to engage respective sunken portions 42*b* disposed on opposed sides of an adjacent upraised portion 42*a* in the outer surface 42 of the male insulator 2*l* as shown in FIG. 13. In this manner, the first and second inwardly extending arms 45*a* and 45*b* prevent relative rotation between the outer metal cylinder 28 and the inner male insulator 21 caused by vibration, and thus provide an anti-rotation function in preventing a change in the relative positions of these two connector components caused by environmental vibrations or physical shock experienced by the mated connector components.

Figure 2:
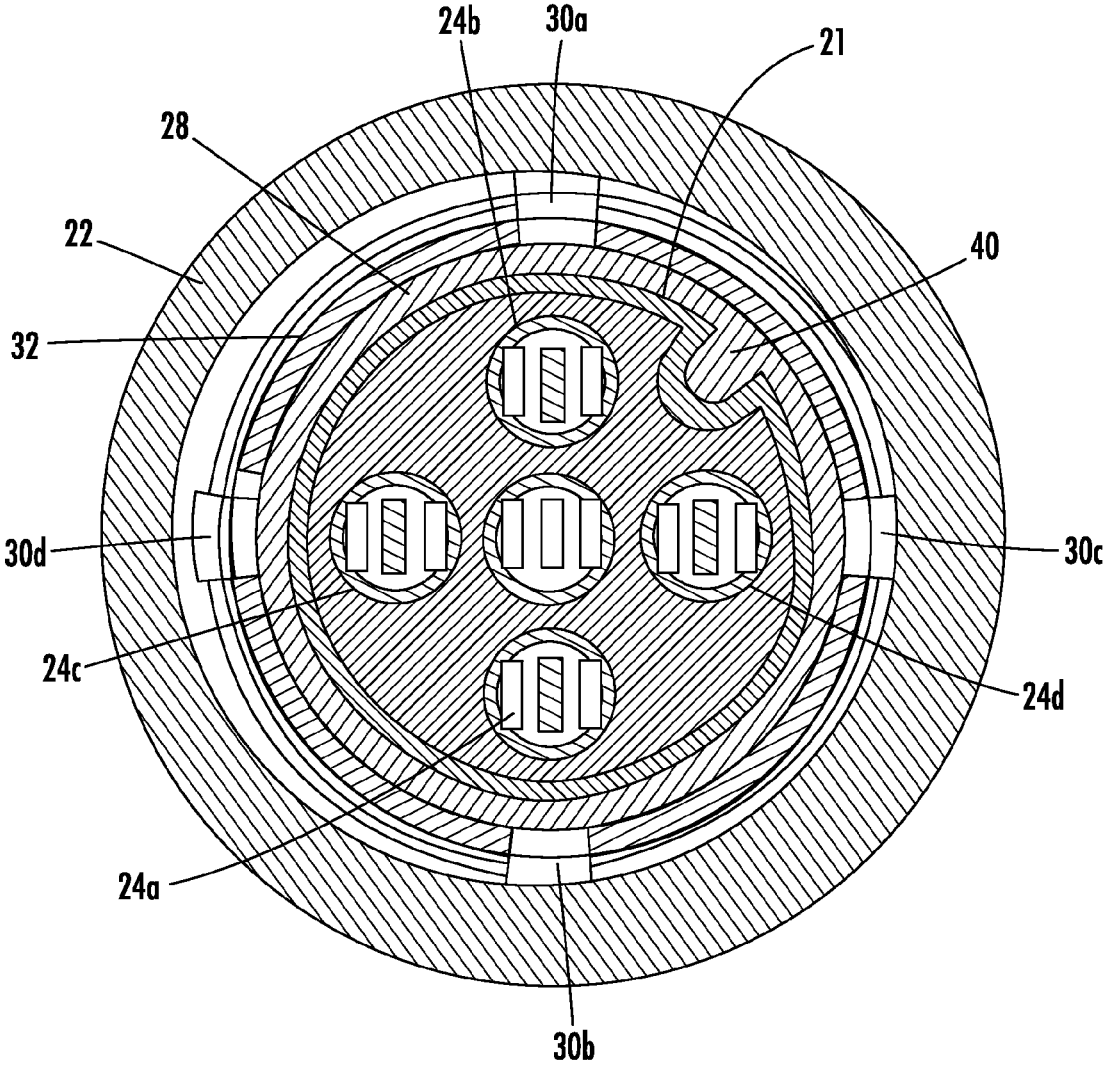
FIG. 2 is a sectional view of the push-lock electrical connector taken along site line B-B in FIG. 1.
Figure 3:
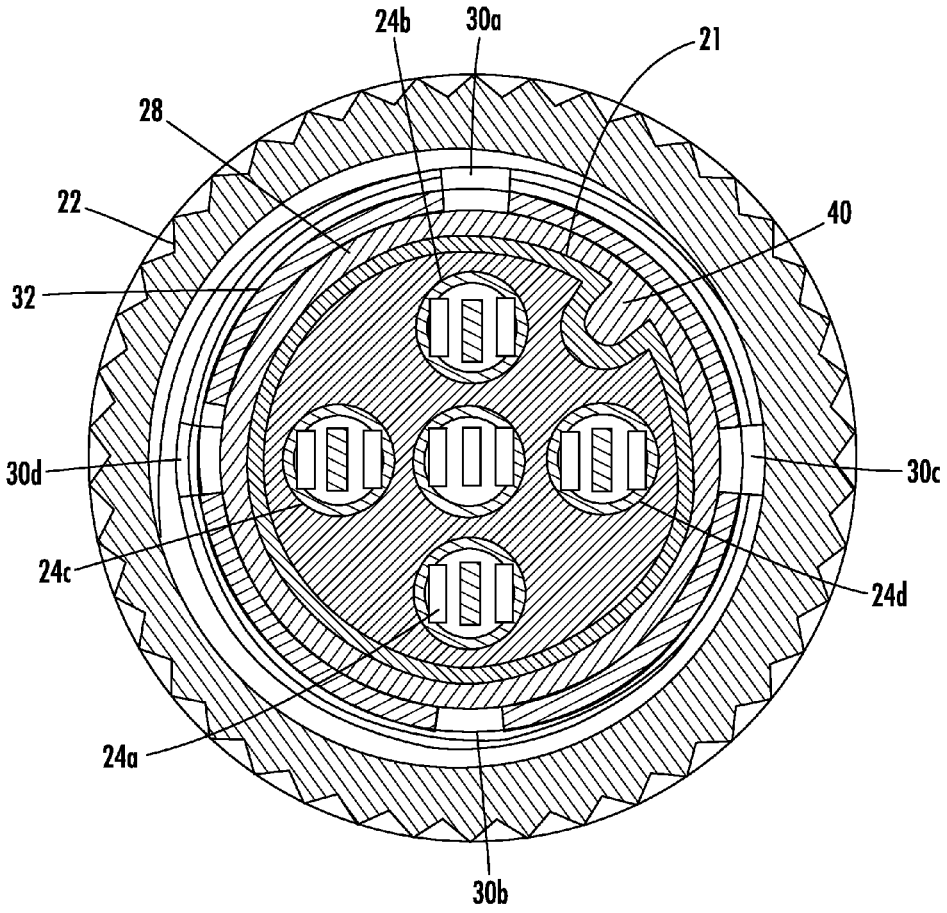
FIG. 3 is a sectional view of the push-lock electrical connector taken along site line A-A in FIG. 1.
Figure 4:
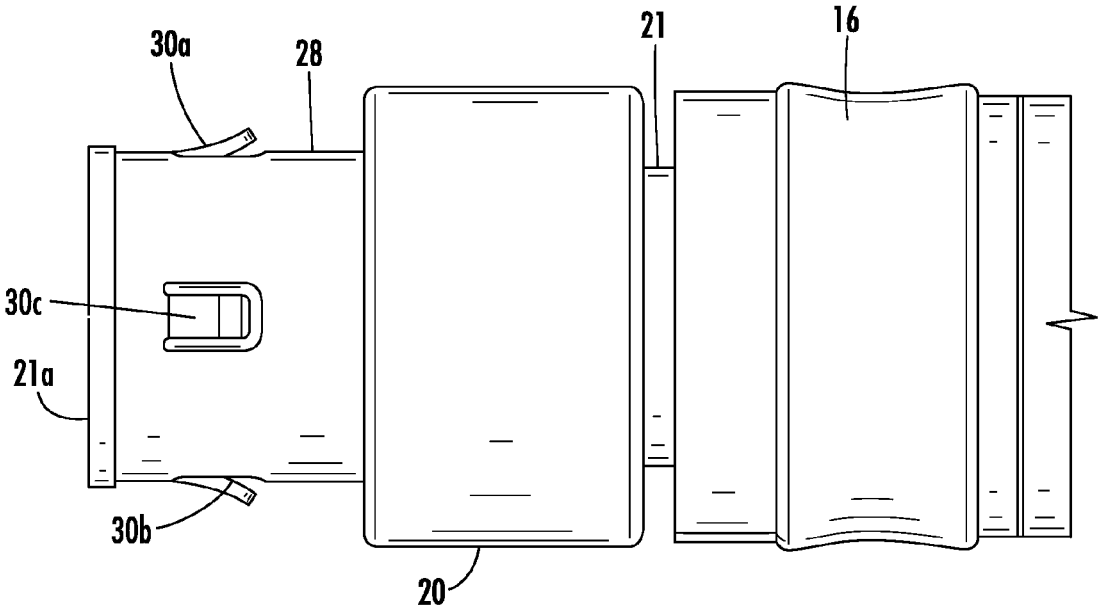
FIG. 4 is a side elevation view of the male connecting member of the push-lock electrical connector.

As shown in FIGS. 2, 3 and 10, male insulator 21 includes an inwardly extending rib 40 on its inner periphery adapted for insertion in a generally U-shaped recessed portion 23*a* within female insulator 23. With inner rib 40 disposed within recessed portion 23*a* of female insulator 23, the four male pins 24*a*-24*d* are respectively aligned with the four female sockets 26*a*-26*d* during assembly of the connector to ensure proper electrical connections are made within the mated male and female connecting members 12, 14.

Figure 14:
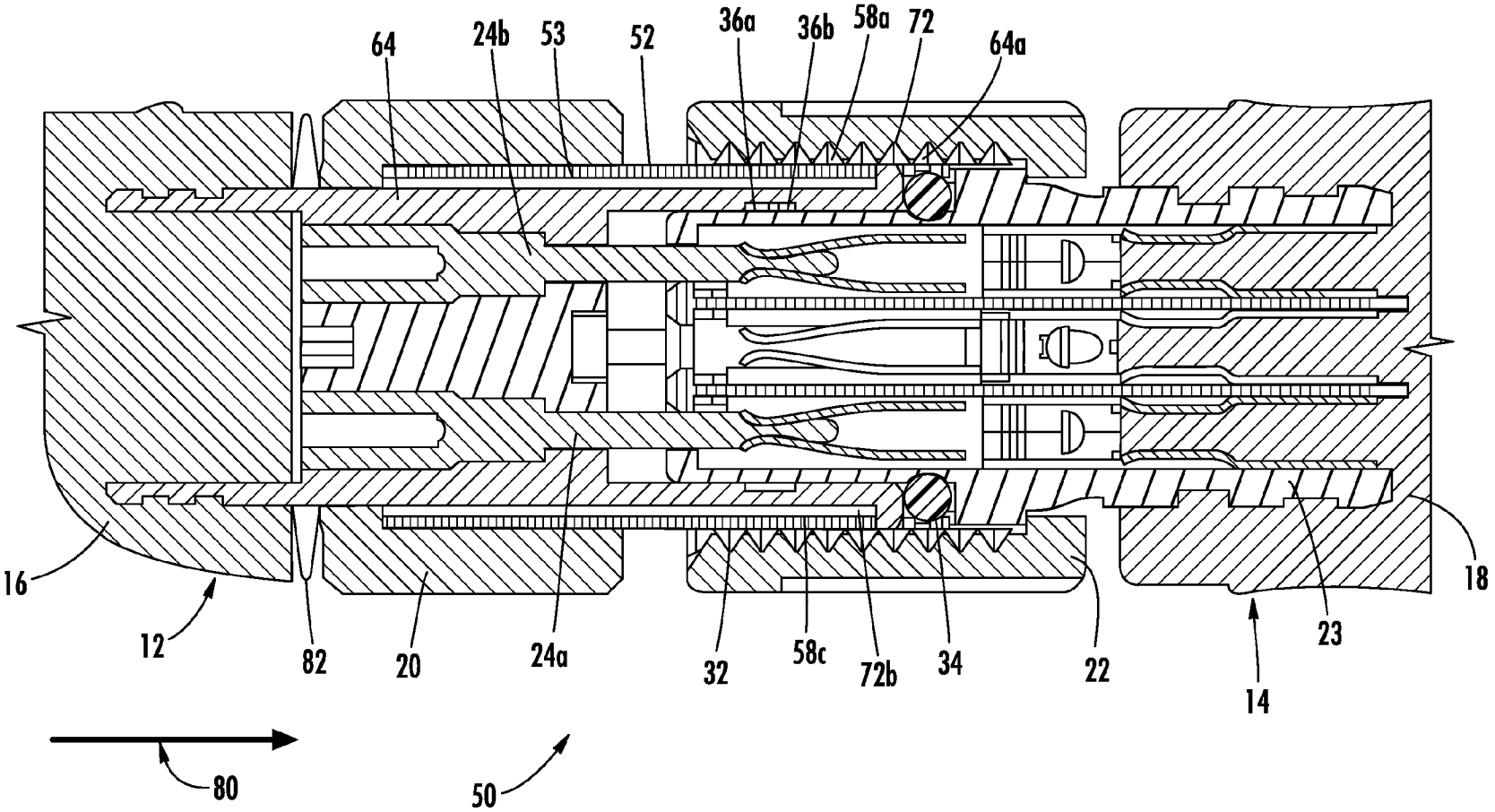
FIG. 14 is a longitudinal sectional view of a second embodiment of the inventive push-lock electrical connector mated to a traditional M12 threaded type electrical connector.
Figure 15:
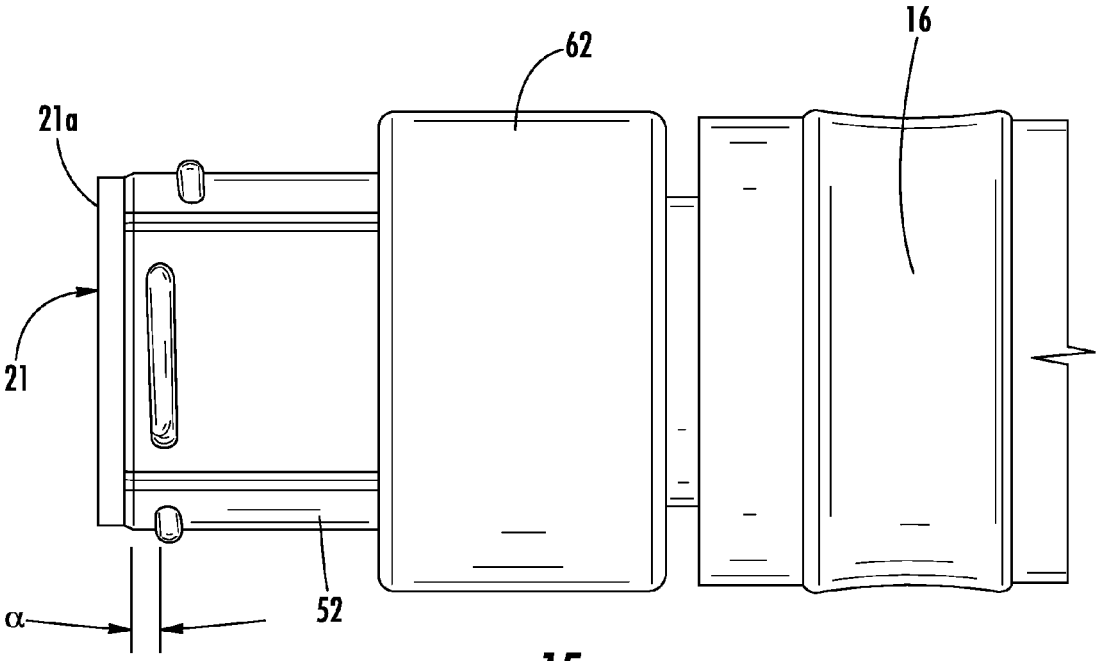
FIG. 15 is a lateral plan view of a portion of the male push-type electrical connector illustrated in FIG. 14.
Figure 16:
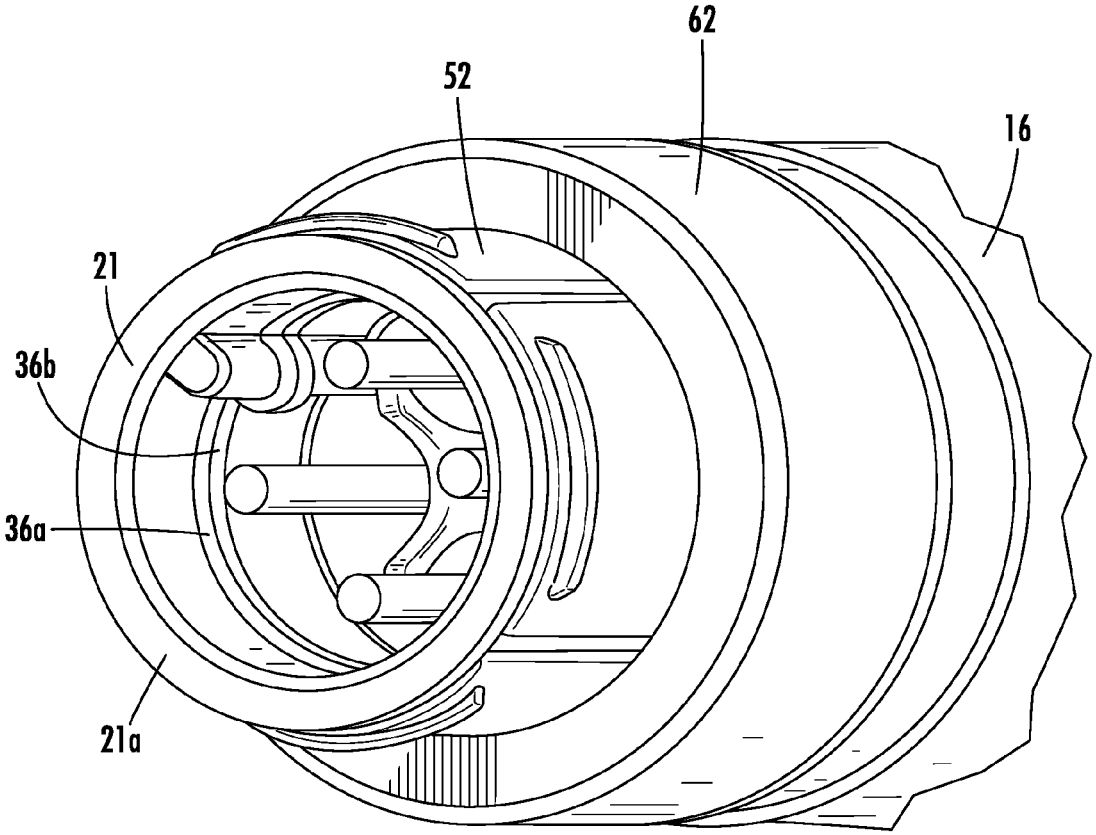
FIG. 16 is a perspective view of the male connector portion of the push-lock electrical connector illustrated in FIG. 14.
Figure 17:
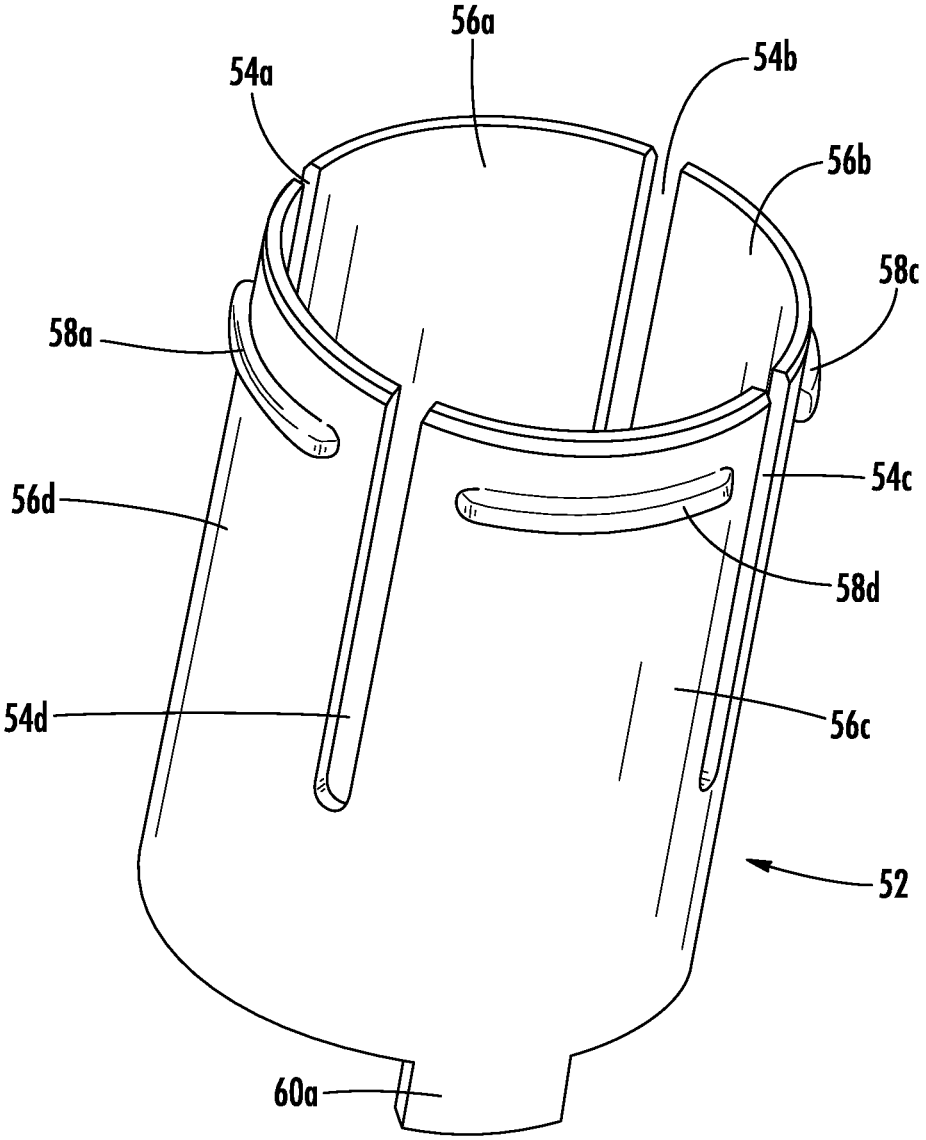
FIG. 17 is a perspective view of the metal cylinder employed in the embodiment of the invention shown in FIG. 14.

Referring to FIG. 14, there is illustrated a longitudinal sectional view of another embodiment of a push-lock electrical connector 50 in accordance with the principles of the present invention. Connector elements common to the first embodiment of the present invention shown in FIG. 1 and the second embodiment shown in FIG. 14 are provided with the same element identifying number. Components of the push-lock electrical connector 50 shown in FIG. 14 which are different than corresponding components in the push-lock electrical connector 10 shown in FIG. 1 are provided with different element identifying numbers. For example, metal cylinder 52 in the push-lock electrical connector 50 embodiment shown in FIG. 14 differs from the corresponding metal cylinder 28 in the embodiment shown in FIG. 1. The male insulator insert 64 in the push-lock electrical connector 50 embodiment shown in FIG. 14 also differs from the male insulator insert 21 in the embodiment shown in FIG. 1 as described in the following paragraphs.

Figure 18:
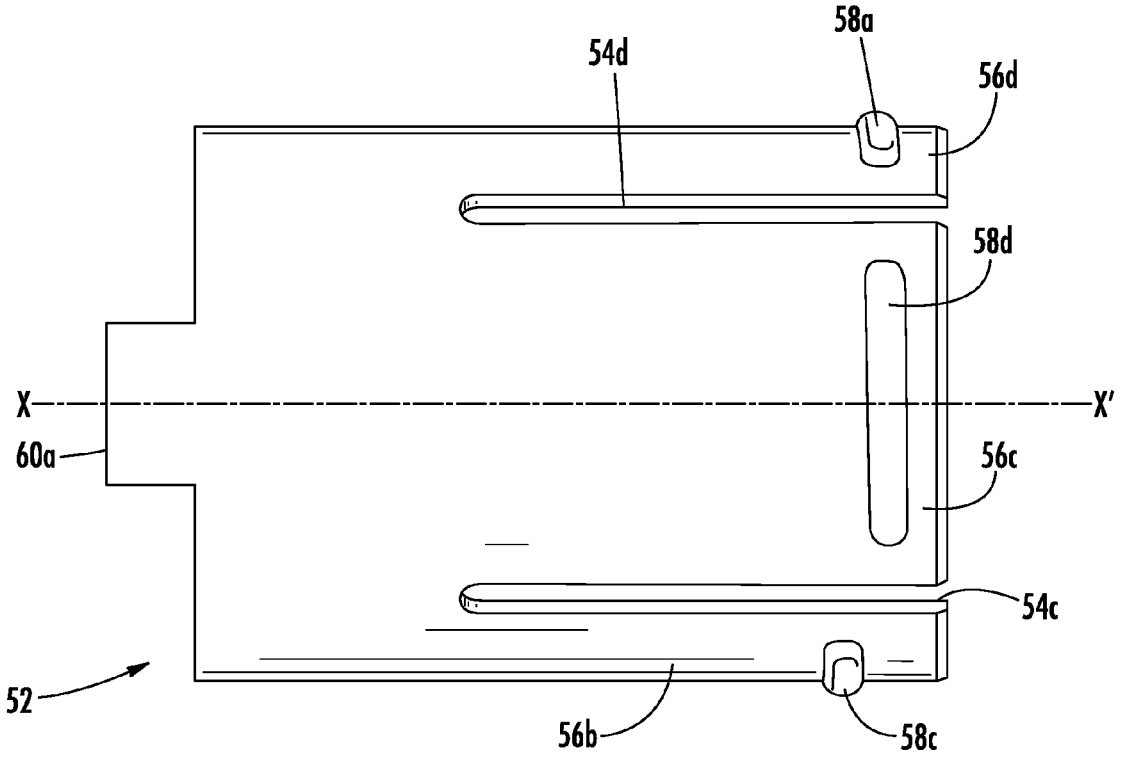
FIG. 18 is a lateral plan view of the metal cylinder illustrated in FIG. 17.
Figure 19:
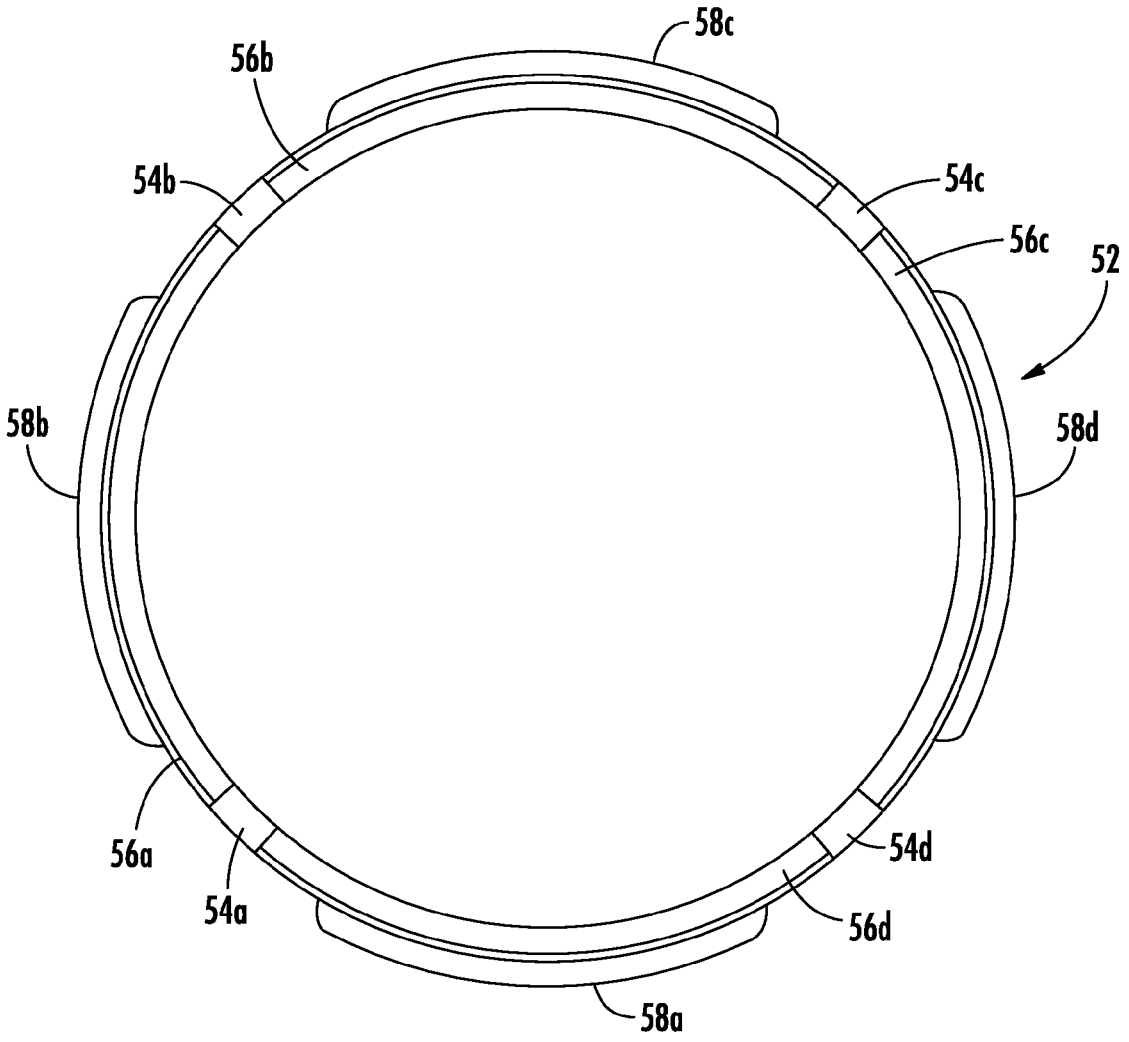
FIG. 19 is an end-on view of the metal cylinder illustrated in FIG. 17.
Figure 20:
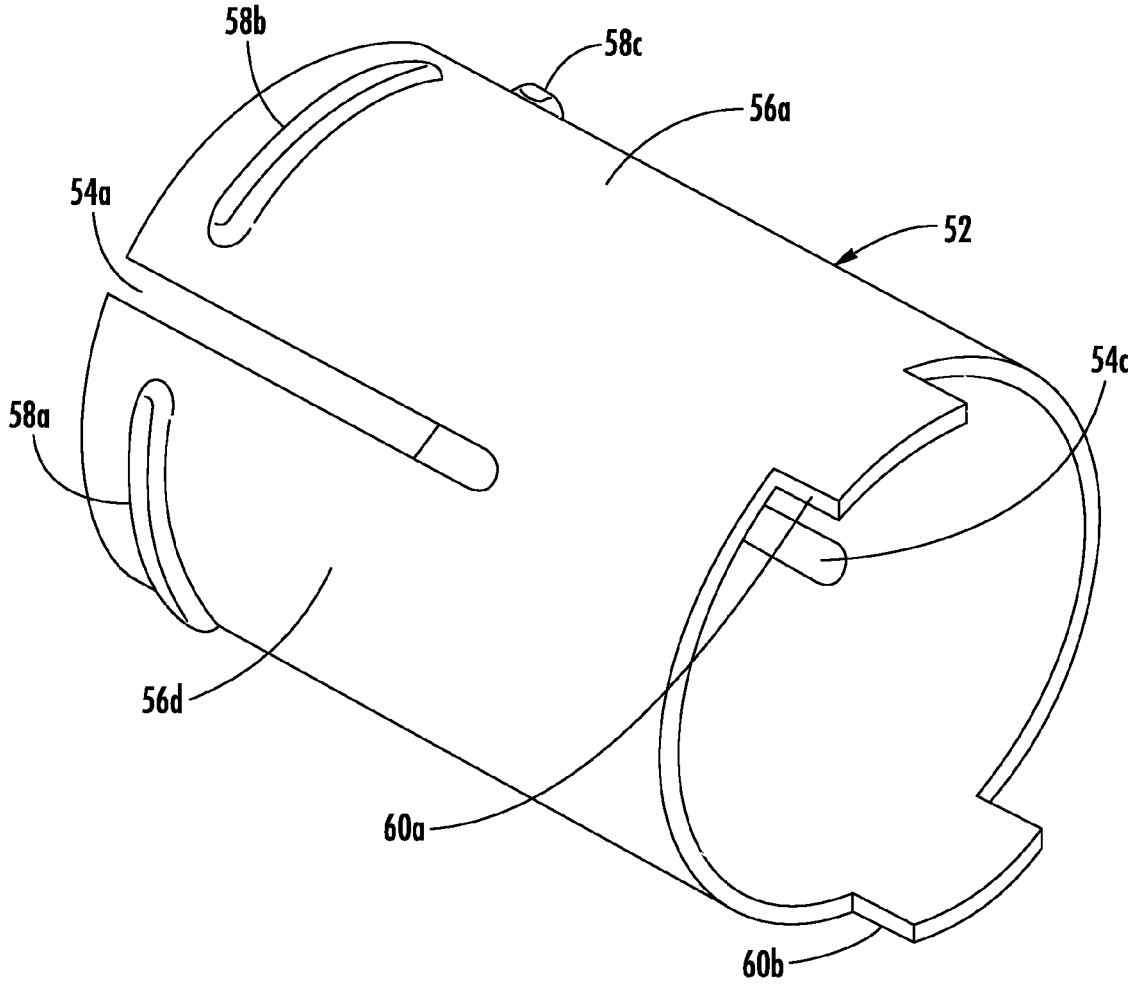
FIG. 20 is another perspective view of the metal cylinder employed in the male electrical connector of FIG. 14.

Referring to FIGS. 15-19, there is shown a second embodiment of the metal cylinder 52 in accordance with the present invention. Metal cylinder 52 includes four generally linearly slots 54*a*-54*d* disposed in a spaced manner about its lateral, cylindrical surface. The space between each pair of adjacent slots defines a respective resilient arm of the metal cylinder 52. Thus, adjacent slots 54*a* and 54*b* define a first resilient arm 56*a*, while adjacent slots 54*b* and 54*c* define a second resilient arm 56*b*. Similarly, adjacent slots 54*c* and 54*d* define a third resilient arm 56*c*, while adjacent slots 54*d* and 54*a* define a fourth resilient arm 56*d*. Disposed adjacent a respective distal end of each of the four resilient arms 56*a*-56*d* is a respective linear projection on its outer surface. Thus, a first linear projection 58*a* is disposed on the outer surface and adjacent to the distal end of the fourth resilient arm 56*d*, while a second linear projection 58*b* is disposed on the outer surface of the first resilient arm 56*a* adjacent its distal end. Similarly, disposed on the outer surface of the second resilient arm 56*b* on its outer surface and adjacent to its distal end is a third linear projection 58*c*, while a fourth linear projection 58*d* is disposed on the outer surface of the third resilient arm 56*c* adjacent its distal end. The four linear projections 58*a*-58*d* are each disposed on a respective outer surface of the first through fourth resilient arms 56*a*-56*d* at an inclined angle relative to a plane orthogonal to the longitudinal axis X-X' as shown in FIG. 18. Inclined angle $\alpha$ equals the inclined angle of the threads 32 disposed on the inner surface of female outer coupling sleeve 22. The four linear projections 58*a*-58*d* are in common alignment about the outer periphery of a metal cylinder 52 and are disposed at the aforementioned inclined angle $\alpha$. Engagement of two opposed linear projections 58*a* and 58*c* with the inner threads 32 of female outer coupling sleeve 22 is shown in the sectional view of FIG. 14. The perspective view of FIG. 16 of male insulator insert 64 shows first and second molded seals 36*a* and 36*b* disposed on the inner surface of the male insulator sleeve so as to engage an outer concentric surface of female insulator insert 23 as in the previously described embodiment.

Figure 21:
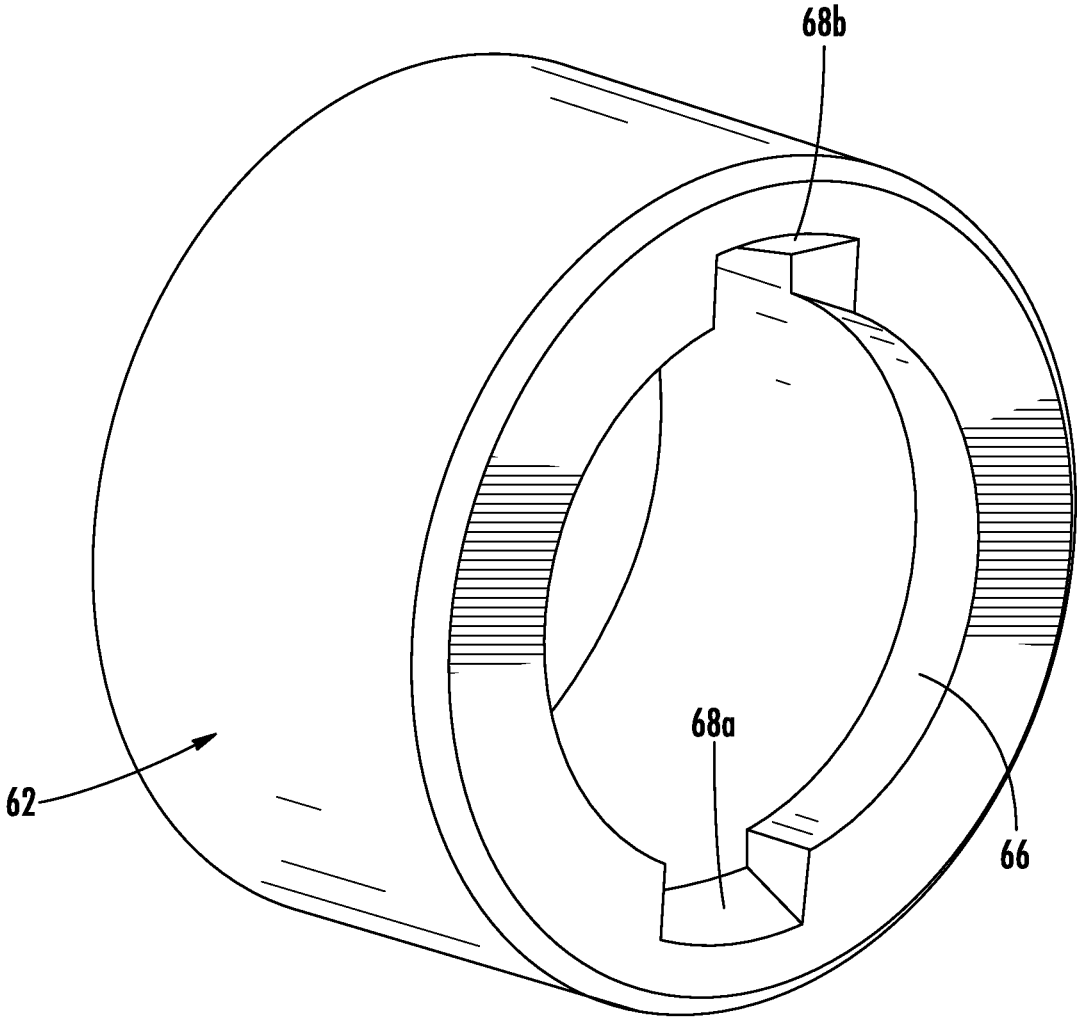
FIG. 21 is a perspective view of the male outer coupling sleeve used with the metal cylinder illustrated in FIGS. 17-20.
Figure 22:
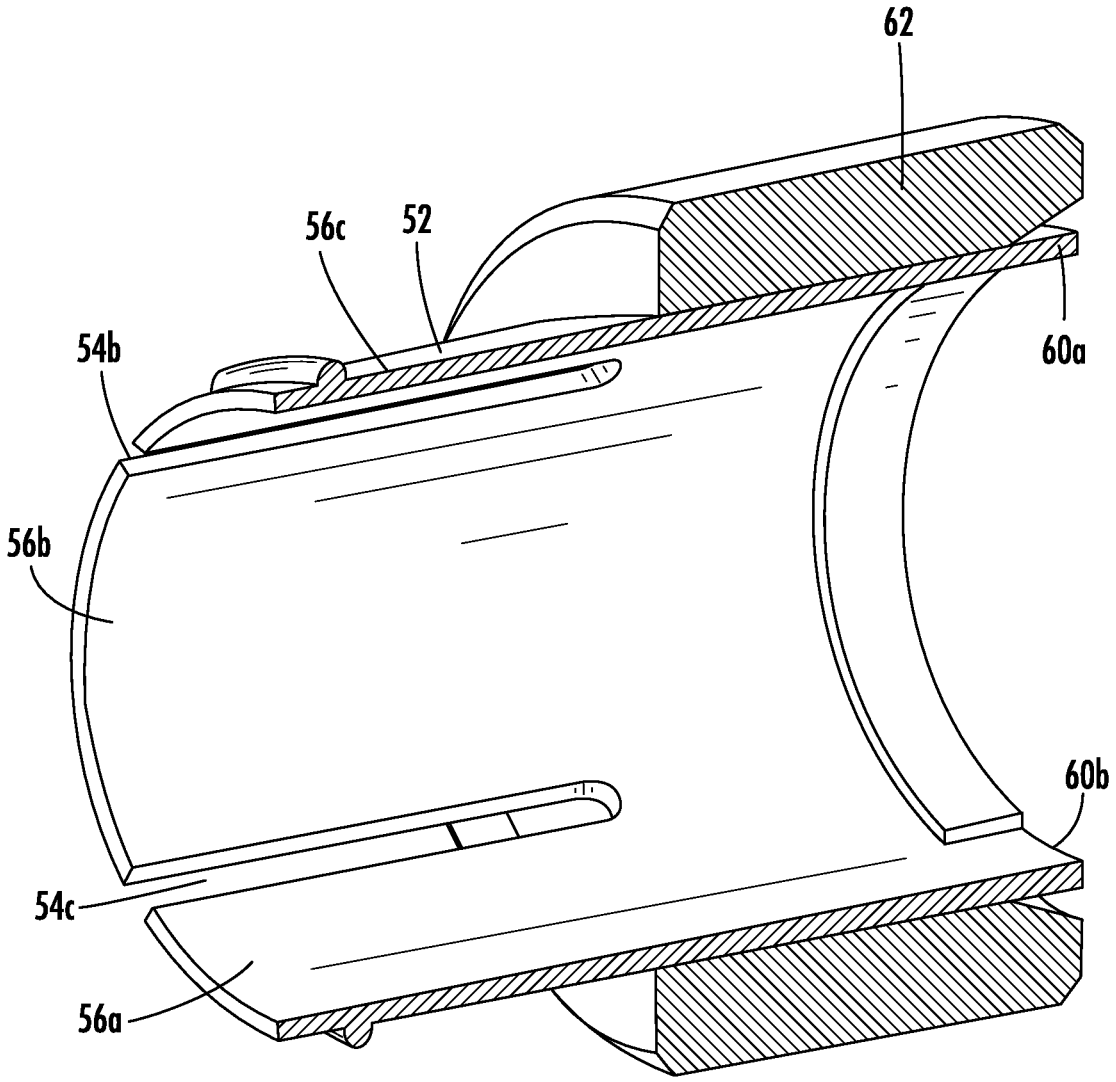
FIG. 22 is a longitudinal sectional view of the combination of the metal cylinder and male outer coupling sleeve incorporated in the male electrical connector of FIG. 14.

As shown in FIGS. 17, 18, 20 and 22, metal cylinder 52 includes a pair of end tabs 60*a* and 60*b* which are disposed on respective opposed end portions of the metal cylinder and extend outwardly along the length of the cylinder. Also shown in FIG. 21 is a perspective view of the male outer coupling sleeve 62 incorporated in the second embodiment of the push-lock electrical connector 50 shown in FIG. 14. Male outer coupling sleeve 62 includes a cylindrical aperture, or slot, 66 extending therethrough. Disposed on opposed end portions of cylindrical aperture 66 are first and second opposed slots 68*a* and 68*b*. With metal cylinder 52 inserted in the cylindrical aperture 66 of male outer coupling sleeve 62, each of the opposed slots 68*a*, 68*b* within the male outer coupling sleeve is adapted to receive a respective one of the opposed end tabs 60*a*, 60*b* on the end of the metal cylinder. Each of the end tabs 60*a*, 60*b* is adapted for outward displacement so as to be positioned within and engage a respective one of the opposed slots 68*a* and 68*b* for securely connecting these two components together. In some cases, conventional means such as weldments may also be used to securely connect these two components. Thus, metal cylinder 52 and male outer coupling sleeve 62 are securely coupled together so that manual engagement and rotational or linear displacement of the male outer coupling sleeve results in a corresponding rotational or linear displacement of the inner metal cylinder attached thereto.

Figure 23:
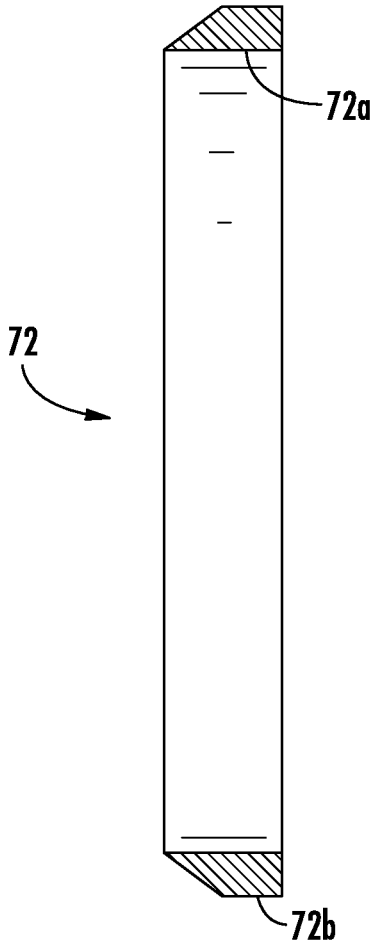
FIGS. 23 and 24 are respectively longitudinal sectional and end-on views of the tapered ring used in the electrical connector of FIG. 14.
Figure 24:
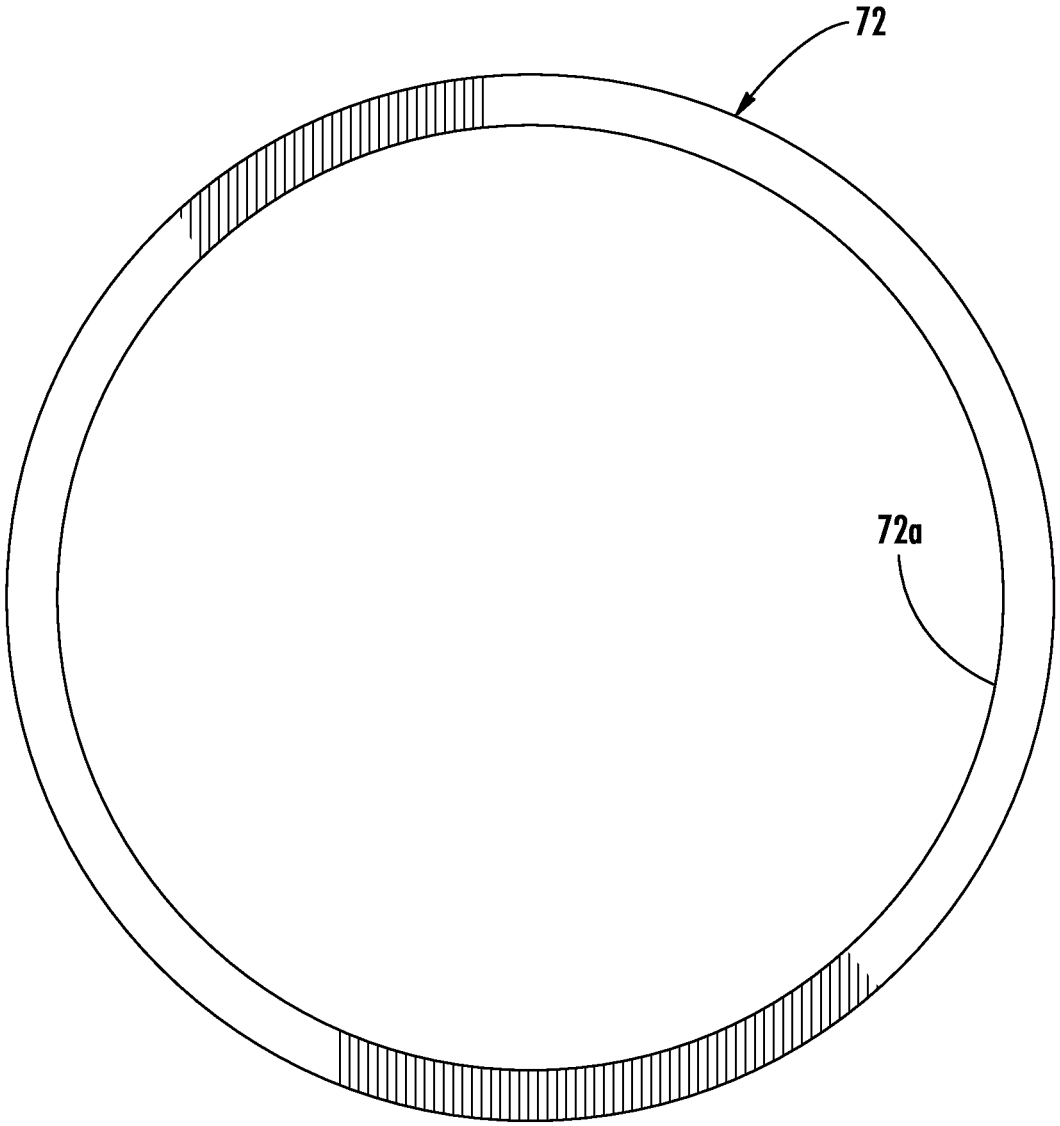

Referring again to FIG. 14, there is shown a tapered ring 72 disposed about and securely attached to the outer surface of male insulator insert 64 adjacent to one end of the male insulator insert. That end of the male insulator insert 64 includes an enlarged circular flange 64*a* disposed about the cylindrical opening at the end of the male insulator insert. A longitudinal sectional view of the tapered ring 72 is shown in FIG. 23, while an axial, or end-on, view of the tapered ring is shown in FIG. 24. Tapered ring 72 includes a circular aperture 72*a* extending through the ring and an outer tapered surface 72*b*, and it is attached to the outer surface of male insulator insert 64 by conventional means such as weldments. Similarly, it is recognized that tapered ring 72 does not need to be a separate part, but could be integrated into male insulator insert 64 by conventional manufacturing methods like molding or die-casting.

As shown in FIG. 14, metal cylinder 52 is disposed in cylindrical spaces formed between an outer surface of male insulator insert 64 and respective inner surfaces of male outer coupling sleeve 20 and female outer sleeve coupling 22. As described above, metal cylinder 52 is fixedly attached to the inner cylindrical surface of male outer coupling sleeve 20. In assembling push-lock electrical connector 50, metal cylinder 52 is inserted into the cylindrical spaces disposed about male insulator insert 64 as described above. When male connecting member 12 is fully inserted into female connecting member 14 and male outer coupling sleeve 20 is displaced leftward in the direction of arrow 80 shown in FIG. 14, the distal, or leading, end of metal cylinder 52 engages the tapered surface 72*b* of circular ring 72 and is urged radially outward toward threads 32 disposed on the inner surface of female outer coupling sleeve 22. Disposed on the outer surface of metal cylinder 52 adjacent its distal end are the aforementioned linear projections 58*a*-58*d*, where only two of these projections 58*a* and 58*c* are shown in the sectional view of FIG. 14. With the distal end of metal cylinder 52 deflected radially outward by tapered ring 72, the metal cylinder's outer projections 58*a*-58*d* are displaced radially outward and into engagement with the inner threads 32 of female outer coupling sleeve 22, as shown for the case of linear projections 58*a* and 58*c* in FIG. 14. In this manner, all of the linear projections 58*a*-58*d* disposed on the outer lateral surface of metal cylinder 52 are inserted into the inner threads 32 of female outer coupling sleeve 22. Disposed about male insulator insert 64 and in end-abutting contact with male overmold 16 and male outer coupling sleeve 20 is a short coiled spring 82 which urges male outer coupling sleeve leftward in the direction of arrow 80 so as to maintain the distal end of metal cylinder 52 in contact with tapered ring 72 so that the metal cylinder's distal end remains outwardly biased so as to maintain the metal cylinder's linear projections 58*a*-58*d* in secure engagement with the inner threads 52 of female outer coupling sleeve 22. With metal cylinder's linear projections 58*a*-58*d* engaging the female outer coupling sleeve's inner threads 32, the combination of male coupling sleeve 20 and metal cylinder 52 may be threadably tightened on the electrical connector to compress O-ring seal 34, as desired. Coiled spring 82 facilitates engagement of the metal cylinder's plural outer projections 58*a*-58*d* with the female outer coupling sleeve's inner threads, but is not essentially for proper operation of the inventive push-lock electrical connector 10.

Figure 25:
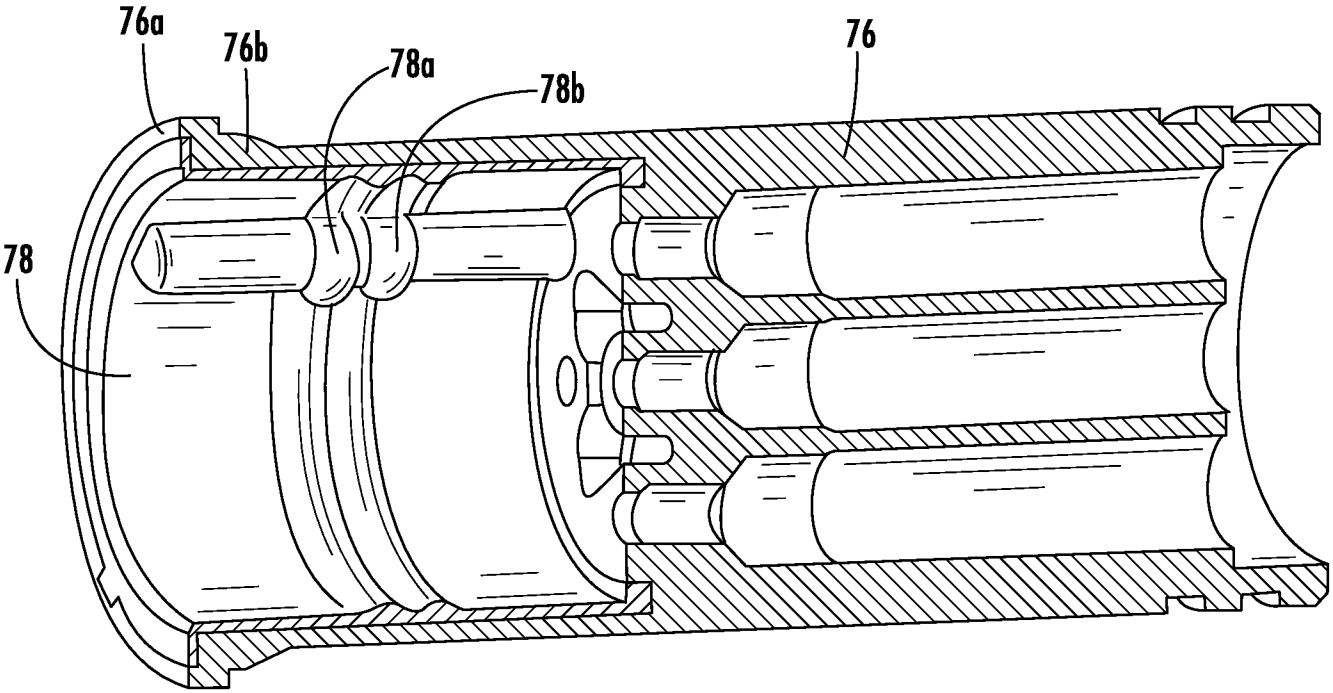
FIG. 25 is a longitudinal sectional view of another embodiment of the male insulator insert used in the electrical connector of FIG. 14, where the male insulator insert is provided with a molded seal on an inner surface thereof.

Referring to FIG. 25, there is shown a longitudinal sectional view of another embodiment of a male insulator insert 76, wherein the open, cylindrical end of the male insulator insert is provided with an enlarged end flange 76*a* and a tapered portion 76*b* which are formed integrally with the male insulator insert. Thus, tapered portion 76*b* of the male insulator insert 76 shown in FIG. 25 replaces the tapered ring 72 described above and illustrated in FIGS. 14, 23 and 24. Disposed on the inner surface of the open end portion of the male insulator insert 76 is a molded flexible seal 78 which adheres to the inner surface of the male insulator insert and includes spaced upraised ring-like portions 78*a* and 78*b* which form seals between the male insulator insert 76 and the female insulator insert which is shown as element 23 in FIG. 14. Molded flexible seal 78 is placed on, adheres to, and conforms with the contours of the inner surface of the open end portion of male insulator insert 76.

Having thus disclosed in detail several embodiments of the invention, persons skilled in the art will be able to modify certain of the structures shown and to substitute equivalent elements for those disclosed while continuing to practice the principles of the invention. For example, while the above discussed embodiments of the present invention are described as having four (4) resilient arms each have a respective outwardly directed thread-engaging member, the present invention is not limited to this specific arrangement and may have more or less of these structural members as the application and composition of these components may dictate. In addition, while cylindrical member is described as disposed radially within the threads of the other connector member, the cylindrical resilient member may also be disposed radial outside of the other connector member and urged radially inward to engage the threads of the other connector member. It is, therefore, intended that all such modifications and substitutions be covered as they are embraced within the spirit and scope of the present invention as described in the claims.

Figure 26:
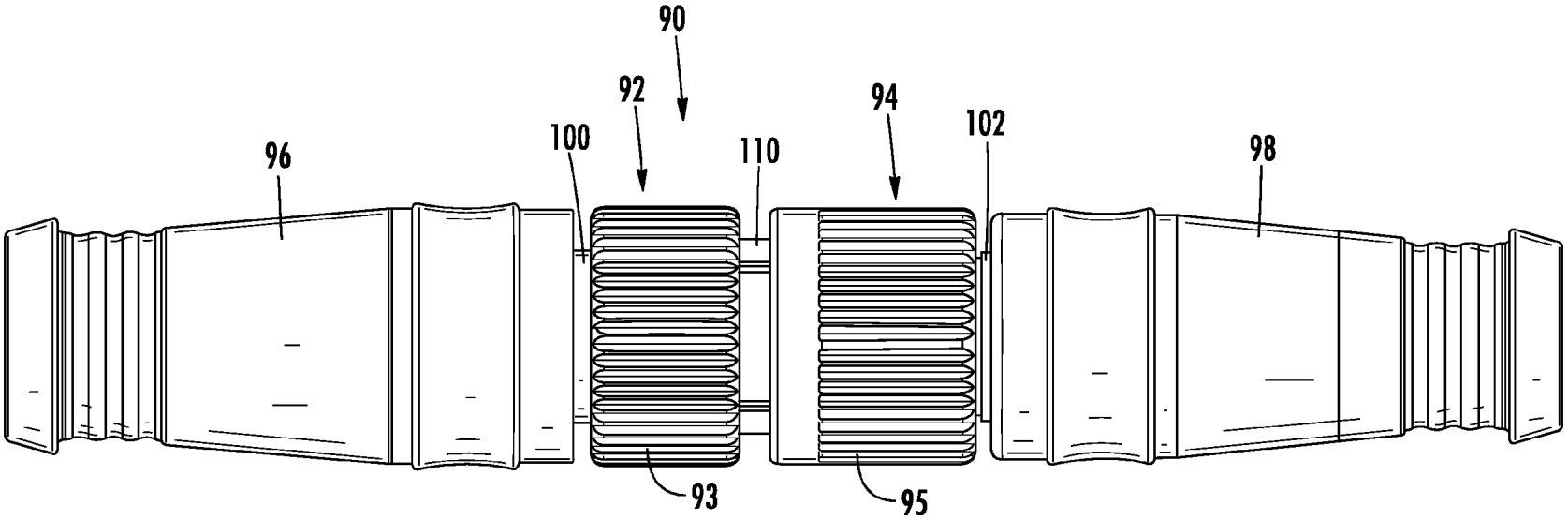
FIG. 26 is a side elevation view of a push-lock electrical connector incorporating an insulator insert in the form of a thin layer of elastic material incorporated between the mated male and female connecting members in accordance with another embodiment of the present invention.
Figure 27:
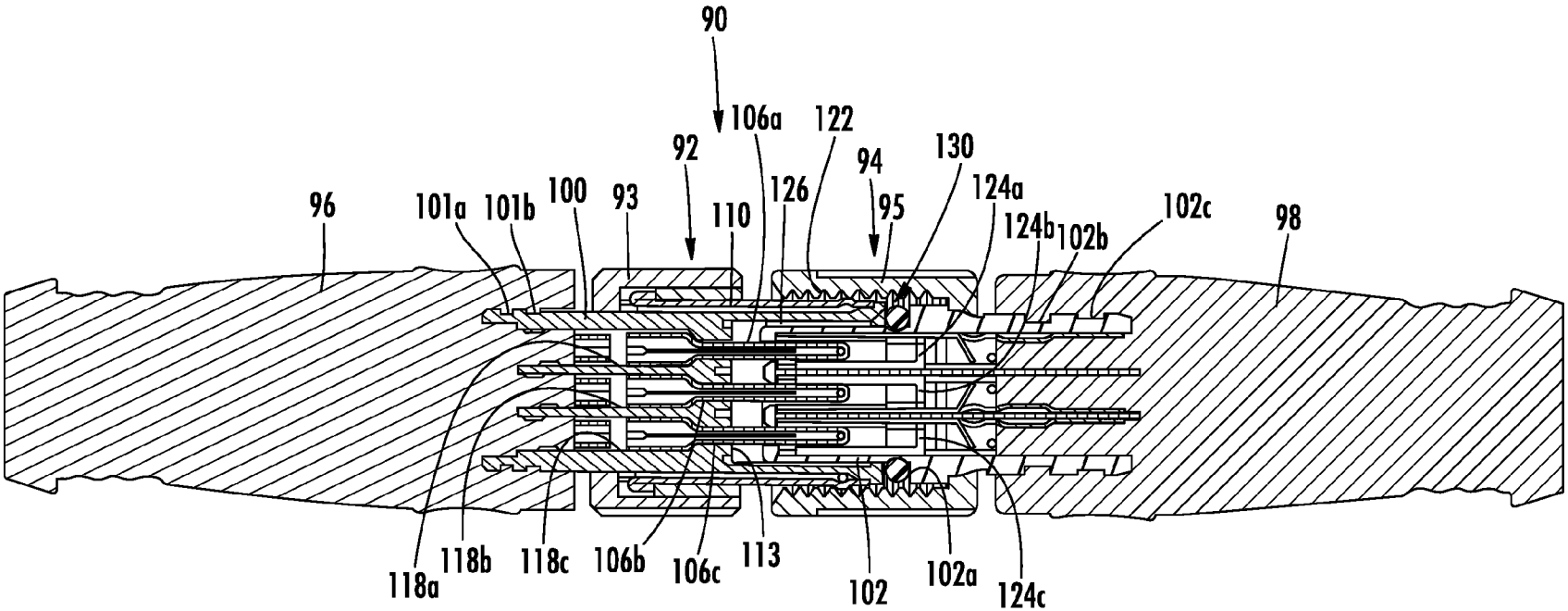
FIG. 27 is a longitudinal sectional view of the push lock electrical connector shown in FIG. 26.
Figure 28:
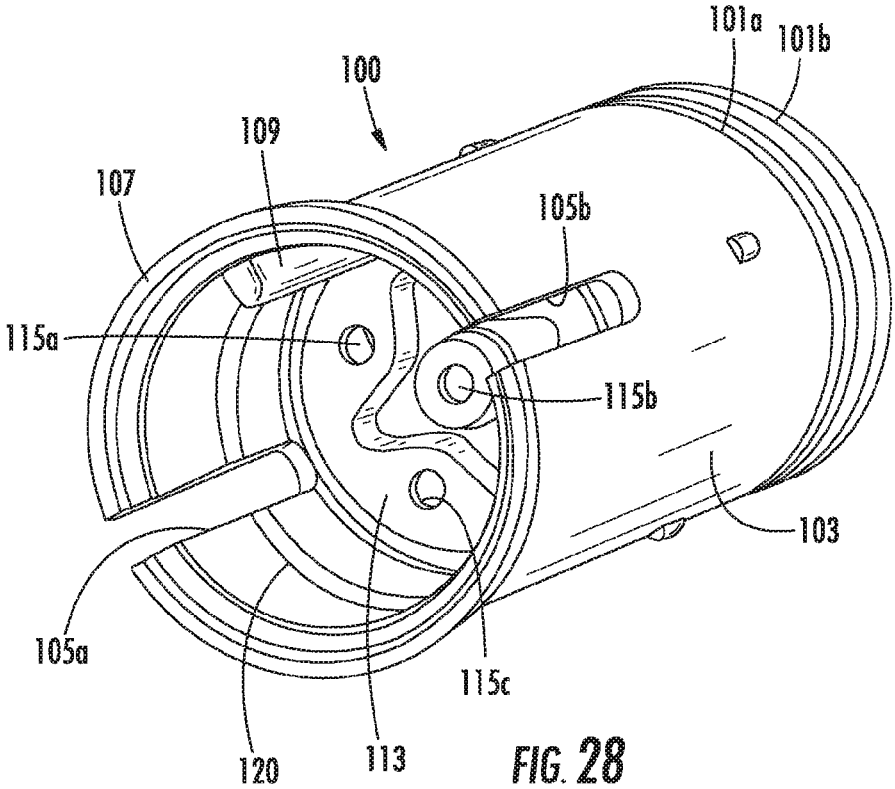
FIG. 28 is a perspective view of the inventive male insulator insert incorporating a pair of spaced slots disposed in a lateral wall thereof.
Figure 29:
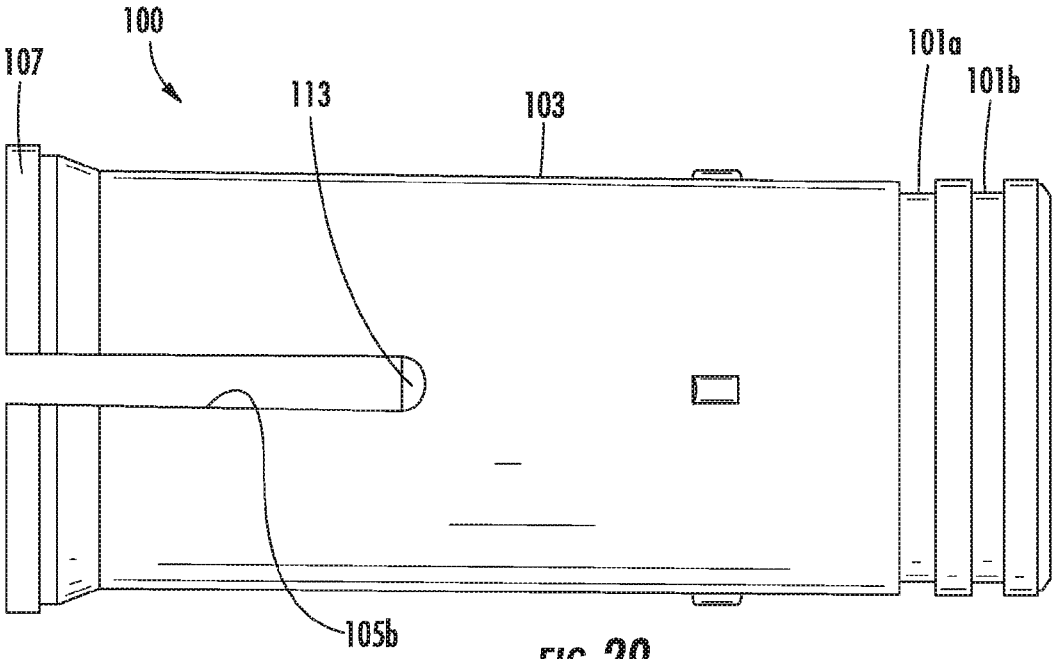
FIG. 29 is a side elevation view of the male insulator insert shown in FIG. 28.
Figure 30:
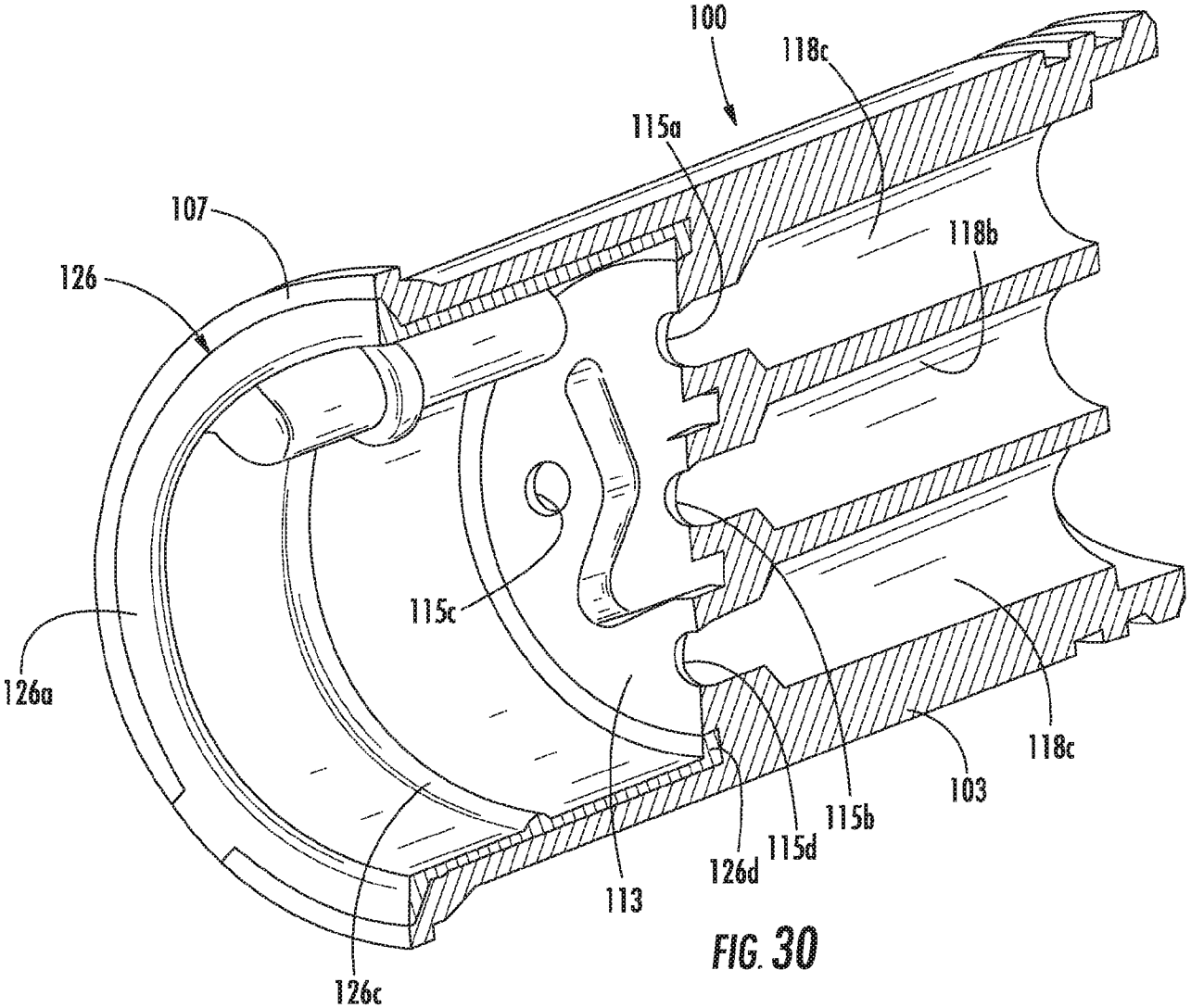
FIG. 30 is a perspective longitudinal sectional view of the male insulator insert shown in FIG. 28 having disposed on a portion thereof a thin layer of elastic insulating material in accordance with this embodiment of the present invention.
Figure 32:
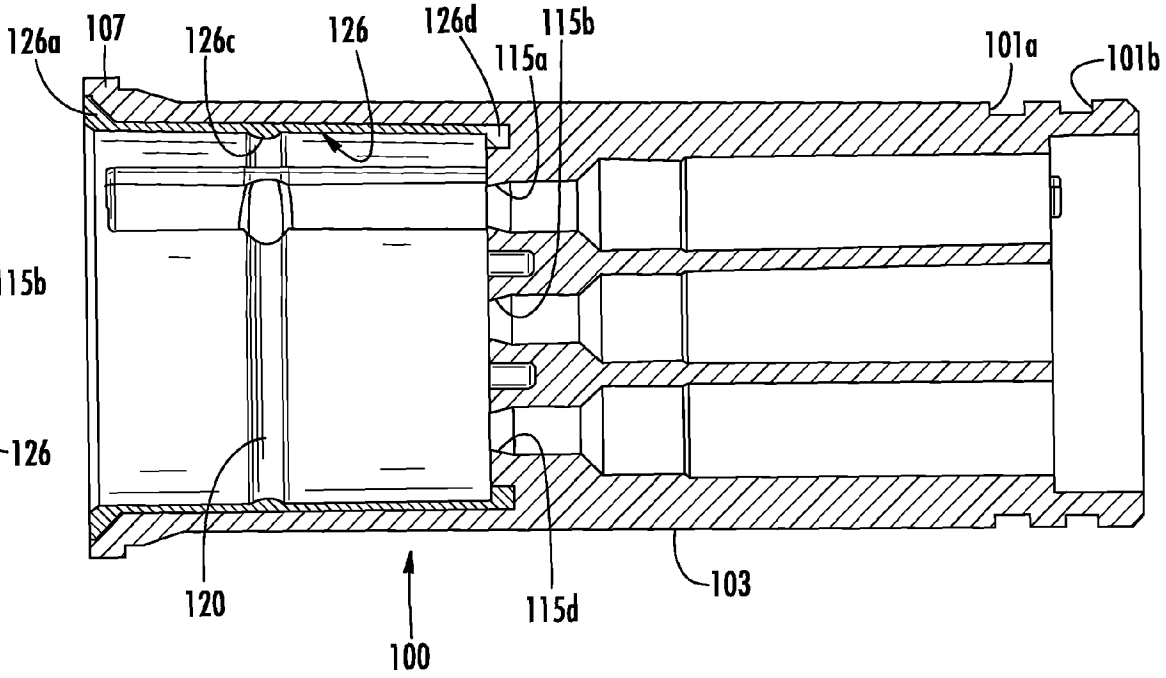
FIG. 32 is a longitudinal sectional view of the male insulator insert taken along site line A-A in FIG. 31 illustrating a layer of electrically insulating material disposed thereon in accordance with this embodiment of the present invention.
Figure 31:
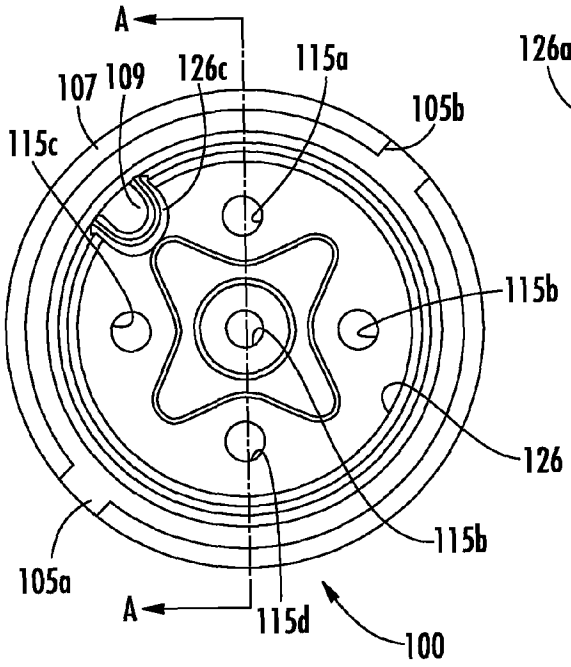
FIG. 31 is an end-on view of the inventive male insulator insert illustrating the pair of end slots therein.
Figure 33:
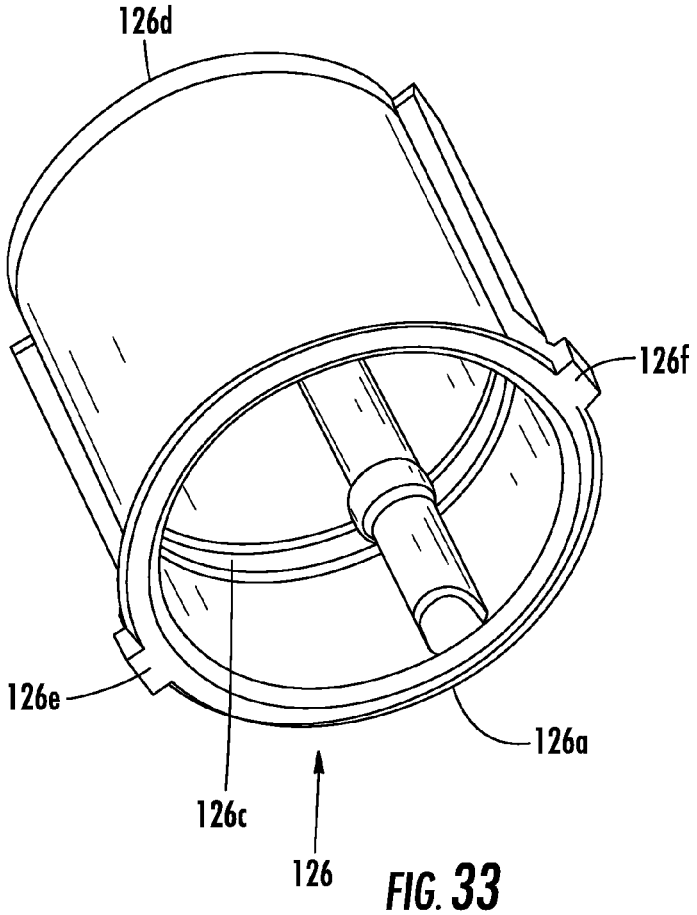
FIGS. 33 and 34 illustrate different perspective views of the elastic electrically insulating layer applied to the open end portion of the male insulator insert in accordance with one embodiment of the present invention.
Figure 34:
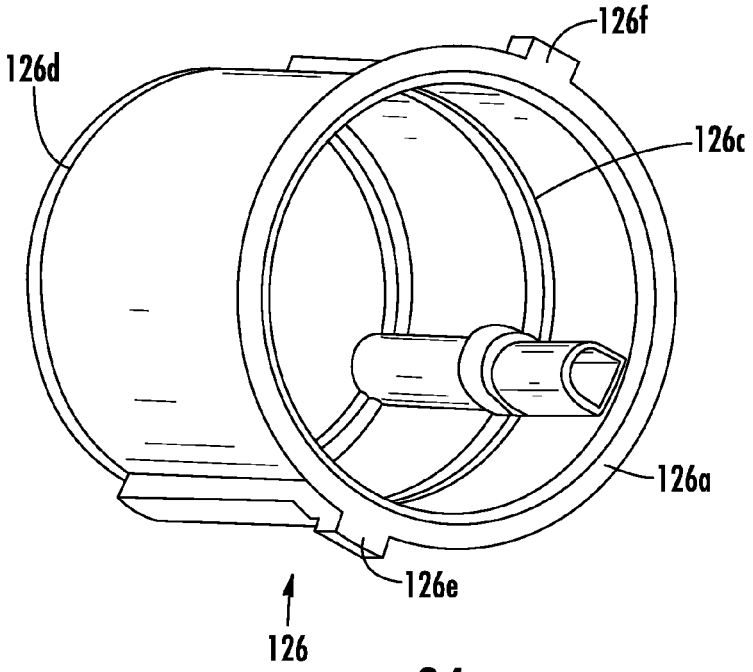

Referring to FIGS. 26 and 27, there are respectively shown side elevation and longitudinal sectional views of a push lock electrical connector 90 incorporating an improved male insulator insert 100 with an elastic electrically insulating layer 126 in accordance with this embodiment of the present invention. FIGS. 28 and 29 are respectively perspective and side elevation views of the inventive male insulator insert 100. FIG. 30 is a perspective sectional view of the inventive male insulator insert incorporating the elastic insulating layer therein. FIGS. 31 and 32 are respectively end-on and longitudinal sectional views of the inventive male insulator insert 100 in accordance with this embodiment of the present invention. FIGS. 33 and 34 are different perspective views of the inventive elastic insulating layer for incorporation in a male insulator insert for use in a push lock electrical connector in accordance with the present invention.

The inventive push lock electrical connector 90 includes a male connecting member 92 and a female connecting member 94. Male connecting member 92 includes an outer male coupling sleeve 93, while female connecting member 94 includes an outer female coupling sleeve 95. Disposed within the outer male coupling sleeve 93 is a male insulator insert 100 in accordance with the present invention. Disposed within the outer female coupling sleeve 95 is a female insulator insert 102 which also may be configured in accordance with the present invention in another embodiment. The use of an elastic electrically insulating material may be incorporated in either the male insulator insert 100 or in the female insulator insert 102, but is not incorporated in both simultaneously. The elastic electrically insulating layer disposed in the male insulator insert 100 is shown as element 126 in FIG. 27 and is described in detail in the following paragraphs. Male insulator insert 100 is securely attached to a male overmold 98 by means of first and second recessed portions 101*a* and 101*b* disposed on the outer end portion of the male insulator insert. Similarly, female insulator insert 102 is securely attached to a female overmold 98 by means of third and fourth recessed portions 102*a* and 102*b*. As in the previously described embodiments, male insulator insert 100 is generally cylindrical and is provided with plural receptacles, or slots, three of which are shown as elements

118*a*, 118*b* and 118*c* and are adapted to receive and retain first, second and third conductive pins 106*a*, 106*b* and 106*c*, respectively.

As shown in the various figures, male insulator insert 100 is provided with a generally cylindrical body 103 having the aforementioned spaced recessed portions 101*a*, 101*b* at a first outer end thereof, and an enlarged end flange 107 on an inner end of the cylindrical body. Disposed within male insulator insert 100 is a generally circular base 113 having five spaced apertures therein, where three of these apertures are shown as elements 115*a*-115*c* in FIG. 28. Each of the five apertures is adapted to receive and support a respective conductive pin as shown for three male pins 106*a*-106*c* in the sectional view of FIG. 27. In the illustrated male insulator insert 100, there is shown an axially positioned center aperture 115*b* and three of four outer apertures 115*a*, 115*c*, 115*d*, where the fifth outer aperture is not shown in any of the illustrated views for simplicity.

Disposed about and attached to the outer lateral wall of male insulator insert's cylindrical body 103 is a metal cylinder 110 as shown in FIG. 27. Disposed on a portion of the outer surface of metal cylinder 110 are outer threads which are adapted to securely engage inner threads on the inner surface of outer female coupling sleeve 95, where the inter-engaging threads are shown as elements 122 in FIG. 27. It is in this manner that the male connecting member 92 is securely attached to female connecting member 94.

Female insulator insert 102 is inserted through a circular aperture within outer female coupling sleeve 95 in a tight-fitting, secure manner, which allows for free rotation of outer female coupling sleeve about the outer surface of female insulator insert 102. With female insulator insert 102 inserted in the open end portion of the male insulator insert 100 as shown in FIG. 27, rotation of the outer female coupling sleeve 95 about the metal cylinder 110, with their mutually engaging inter-locking threads 122, allows for secure coupling between male connecting member 92 and female connecting member 94. An outer lateral portion of female insulator insert 102 is provided with a flange 102*a* extending radially outward from the female insulator insert's outer wall. Flange 102*a* is adapted to engage and compress a generally circular O-ring seal 130 disposed between this flange and the aforementioned end flange 107 disposed on the inner edge portion of the male insulator insert 100 as shown in FIG. 27. Further rotation of the outer female coupling sleeve 95 relative to the male insulator insert 100 further compresses O-ring seal 130 in forming a tighter seal between the male and female connecting members 92 and 94.

As also shown in FIG. 27 and as discussed above, the inner end portion of female insulator insert 102 is adapted for tight fitting engagement with the inner surface of the open end portion of the male insulator insert 100. Female insulator insert 102 is provided with plural spaced female sockets, where three of the sockets are shown as elements 124*a*, 124*b* and 124*c* in FIG. 27. Thus, socket 124*a* is adapted to receive conductive pin 106*a* in a tight-fitting manner, and female sockets 124*b* and 124*c* are adapted to receive conductive pins 106*b* and 106*c*, respectively. It is in this manner that the male and female connecting members 92, 94 are electrically connected to each other.

The cylindrical body portion 103 of male insulator insert 100 is provided in accordance with the present invention with at least one elongated, linear slot. In the embodiment shown in FIGS. 28 and 29, first and second elongated, linear slots 105*a* and 105*b* are shown disposed on opposed portions of the male insulator insert's cylindrical body. Each of the first and second elongated slots 105*a*, 105*b* extends inwardly from the end flange 107 toward the opposite end of the cylindrical body 103 to, and slightly beyond, base member 113 which is attached to the inner surface of the cylindrical body. Also disposed on the inner surface of cylindrical body 103 and aligned generally parallel to the opposed ends of the cylindrical body is a non-continuous, generally circular seal flange 120. Seal flange 120 is discontinuous because of its intersection with the first and second slots 105*a*, 105*b* within the cylindrical body 103. In the embodiment shown in the figures, seal flange 120 is comprised of two spaced sections each forming generally a one-half circle within cylindrical body 103, with adjacent ends of the two half circles separated by either the first slot 105*a* or the second slot 105*b*. As in the case of end flange 107, the seal flange 120 is preferably formed integrally with the cylindrical body 103 such as in a molding process. Seal flange 120 forms a circumferential seal with the outer surface of the female insulator insert 102 disposed within the open end portion of male insulator insert 100.

In accordance with this embodiment of the present invention, first and second slots 105*a*, 105*b* within the end of the insulator insert's cylindrical body 103 allow the two semi-cylindrical portions of the cylindrical body formed by the two slots to flex outwardly to facilitate insertion of a female insulator insert 102 into the open end portion of the male insulator insert 100. This flexure allows the male insulator 100 to receive female insulator inserts having a wide range of diameters. Specified tolerances in the manufacture of mating members of push lock connectors result in a range of values for various connector components, such as the male and female insulator inserts. These variations in size over an acceptable, specified range are present even in individual manufacturing runs and arise because of the precision limits inherent in the manufacturing process. Incorporating a tolerance range in size for various connector parts and components facilitates manufacture and assembly of the connectors and substantially reduces the costs of manufacture and assembly. While the cylindrical body 103 of male insulator insert 100 is described and illustrated as having first and second spaced slots 105*a*, 105*b*, the present invention is not limited to only a pair of slots, as the present invention may have additional elongated, linear slots to form additional flexible peripheral sections of the cylindrical body depending upon the type of material that the connector is comprised of and the extent of flexibility desired in the male and female insulator inserts 100. As stated above, male insulator insert 100 may also be provided with a single elongated, linear slot.

To accommodate the first and second slots 105*a*, 105*b* in the male insulator insert's cylindrical body 103, while continuing to provide a high degree of electrical insulation for the conductive pins in the male insulator insert 100 and the conductive pin receiving slots 118*a*, 118*b* and 118*c* within the female insulator insert 102, an elastic electrically insulating layer 126 is applied to the inner surface of the open end of the male insulator insert's cylindrical body in accordance with this embodiment of the present invention. Elastic insulating layer 126 is deposited on the inner surface of the open end portion of male insulator insert 100 which terminates in end flange 107 as shown in FIGS. 27, 30, 31 and 32. Elastic insulating layer 106 is deposited by conventional means such as spraying, dipping or other conventional means. The present invention is formed in a two mold process where a first mold is used to form the male insulated insert 100, with the second mold process involving the positioning of an insulating material in the space between a second mold's outer surface and the male insulator insert's inner surface. Elastic insulating layer 126 includes an outer angled enlarged portion 126*a* adapted to intimately engage and be securely attached to an inner portion of the insulator insert's end flange 107. Elastic insulating layer 126 further includes an enlarged intermediate circular portion 126*c* extending radially inward so as to securely engage and attach to the seal flange 120 disposed on the inner surface of male insulator insert 100. Thus, the inner circular portion 126*c* of elastic insulating layer 126 serves not only to electrically insulate the electrically conductive members of the push-lock connector 90, but also serves as a seal between the male and female insulator inserts 100, 102. Elastic insulating layer 126 further includes an inner flange 126*d* adapted for positioning within an annular slot within an inner portion of the male insulator insert's cylindrical body 103 to form an inner seal between the male insulator insert 100 and the female insulator insert 102 disposed within the open end of the male insulator insert. In a preferred embodiment, the male and female insulator inserts 100, 102 are comprised of a semi-rigid thermoplastic material such as of polycarbonate plastic, while the elastic electrically insulating layer 126 is preferably comprised of a thermoplastic, or thermosetting, elastomer.

Disposed on an outer portion of elastic insulating layer 126 and positioned within the first and second slots 105*a* and 105*b* of the male insulator insert 100 are first and second elongated, linear flanges 126*e* and 126*f* as shown in the perspective views of FIGS. 33 and 34. First and second slot-spanning flanges 126*e* and 126*f* provide an insulating layer bridging adjacent portions of the male insulator insert 100 which form the first and second slots 105*a* and 105*b* within the cylindrical body 103 of the male insulator insert. The elasticity of the insulating layer 126 allows it to continue to span the first and second slots 105*a* and 105*b* as they increase in width when a female insulating insert 102 larger in its outer diameter than the male insulator insert's inner diameter is inserted in the open end portion of the male insulator insert. Thus, electrical insulation is maintained around the entire periphery of the open end portion of the male insulator insert 100 which engages and encloses the female insulator insert 102. Upon removal of an oversized female insulator insert 102 from the open end portion of the male insulator insert 100, the diameter of the open end portion of the male insulator insert assumes its original reduced diameter as the facing lateral portions of the cylindrical body 103 assume their original relative positions. As indicated above, the elastic electrically insulating layer 126 is preferably comprised of silicone, but may be of virtually any electrically insulating plastic elastomer composition, such as polyurethane or a low durometer epoxy. The thickness of each of the elastic insulating layer's first and second slot-spanning flanges 126*e*, 126*f* is preferably on the order of the thickness of the male insulator insert 100, which is typically in the range of 0.007-0.008 inch. While the elastic insulating layer 126 has been described primarily in terms of being an electrical insulator, it may also be comprised of a material capable of providing electromagnetic interference (EMI) protection. Conductivity of the elastic electrically insulating layer 126 may be provided by introducing electrically conductive particles such as of carbon powder in the elastic insulating layer to provide an EMI shielding capability. This approach for providing electrical insulating and/or EMI shielding protection could also be used between the male and female connecting members in a coaxially connector.

Persons skilled in the art will be able to modify certain of the structures and materials illustrated and disclosed in the latest embodiment of the present invention to substitute equivalent elements and materials for those disclosed while continuing to practice the principles of the invention. For example, while only two spaced slots are disclosed in the cylindrical body of the male insulator insert, a single slot or more than two slots may be provided and the same process as disclosed above may be used to fill the single slot or the additional slots with electrically insulating or electromagnetic shielding materials.

Figure 35:
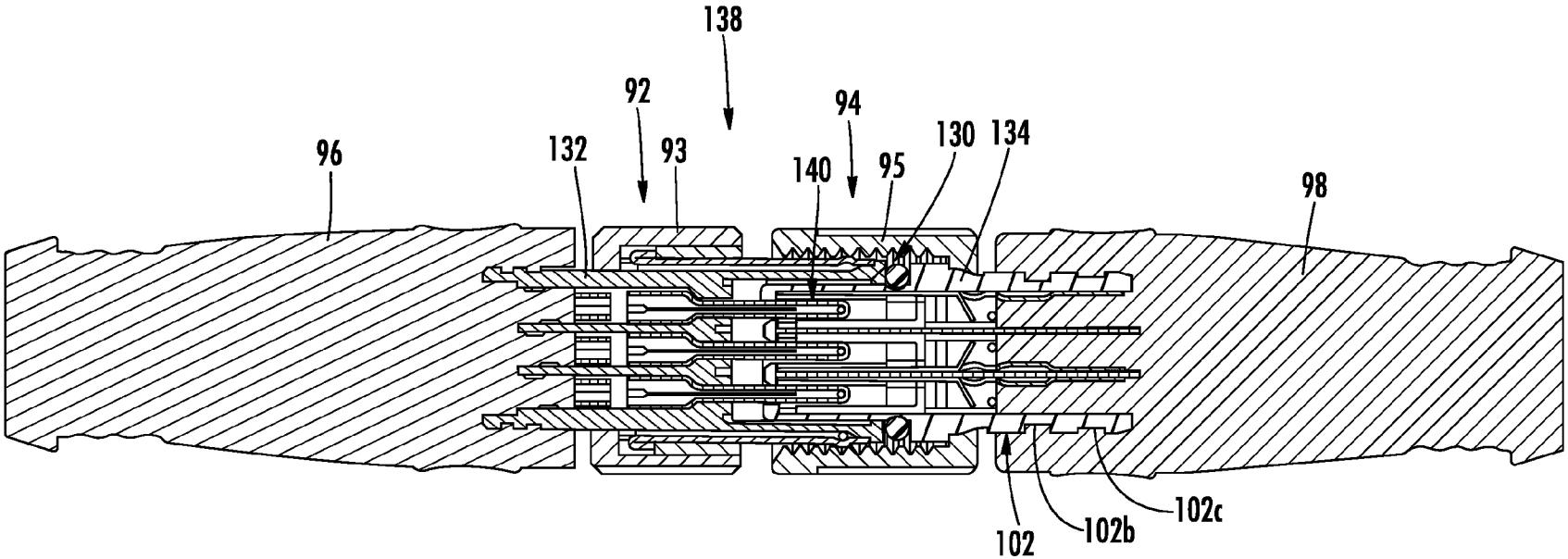
FIG. 35 is a longitudinal sectional view of another embodiment of the present invention, wherein the female insulator insert is adapted to receive in a tight fitting manner male insulator inserts having a range of diameters.

Referring to FIG. 35, there is shown a longitudinal sectional view of another embodiment of a push lock connector 138 in accordance with the present invention. In FIG. 35, components of push lock connector 38 which are the same as, and perform the same function as, a corresponding component in the push lock connector 90 illustrated in FIGS. 26-34 have been provided with the same identifying numbers. The difference between the embodiment of the invention illustrated in FIGS. 26-34 and the embodiment now described is in the male and female insulator inserts as well as in the elastic electrically insulating layer attached to an insulator insert. In the embodiment shown in FIGS. 35-39, the female insulator insert 102 is provided with, and is attached to, the elastic electrically insulating layer, or ring, 140. As in the previously described embodiments, the embodiment of the push lock connector 138 shown in FIGS. 35-39 and described in the following paragraphs is also provided with male and female connecting members 92, 94, outer male and female coupling sleeves 93 and 95, and male and female overmolds 96 and 98.

Figure 37:
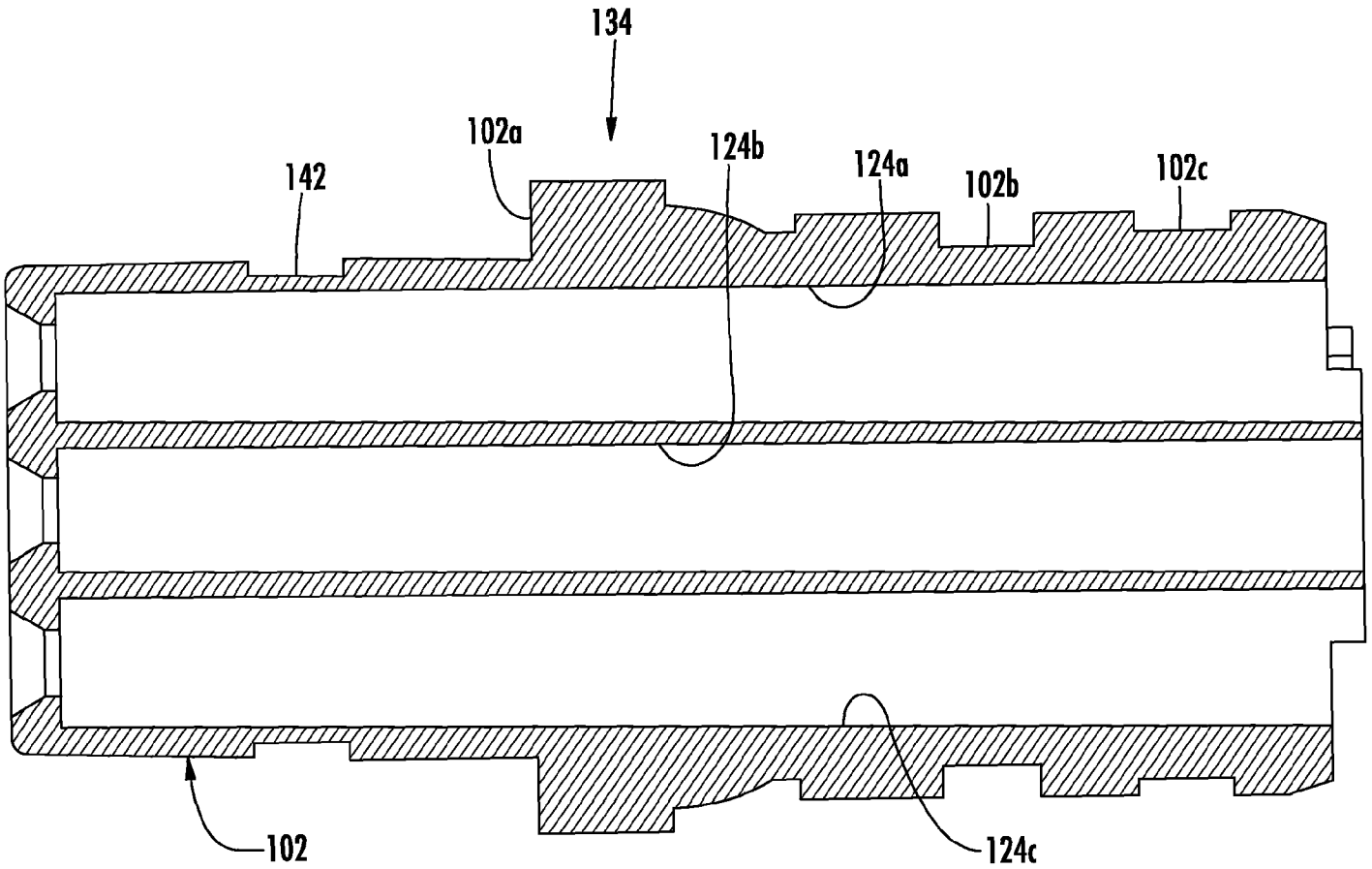
FIG. 37 is a longitudinal sectional view of the inventive female insulator insert used in the embodiment of the invention illustrated in FIG. 35.
Figure 36:
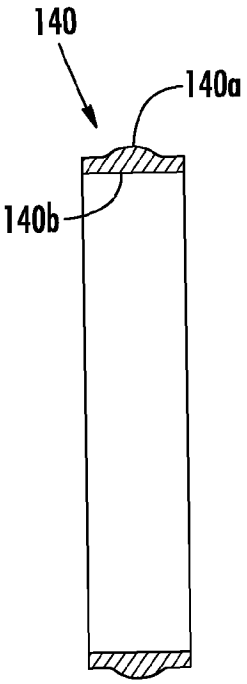
FIG. 36 is a transverse sectional view of an elastic electrically insulating layer, or ring, for use in the female insulator insert illustrated in FIG. 35.
Figure 38:
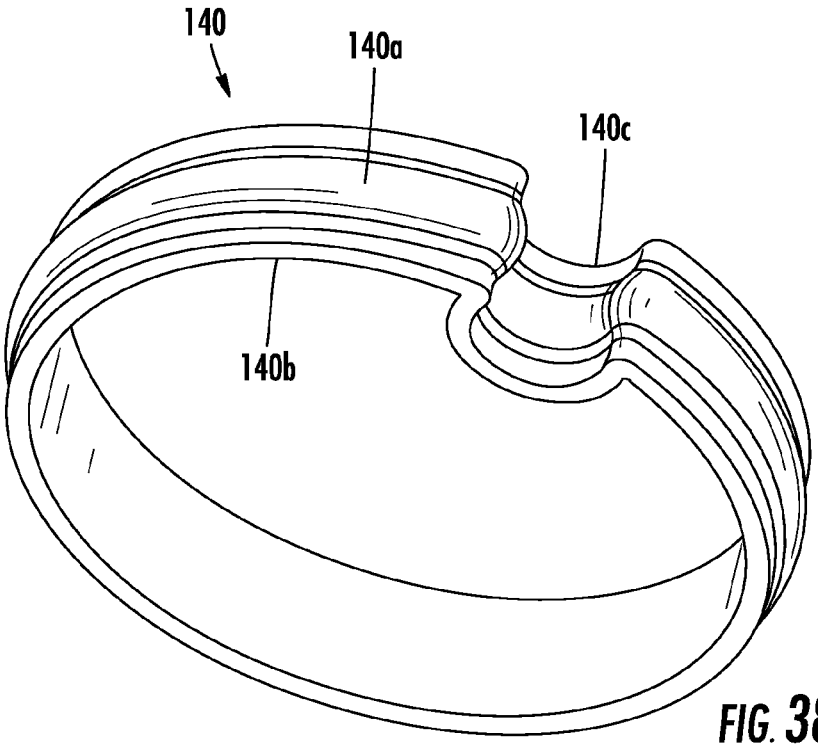
FIGS. 38 and 39 are different perspective views of the elastic electrically insulating insert shown in FIG. 36 which is adapted for use with the female insulator insert of FIG. 37.
Figure 39:
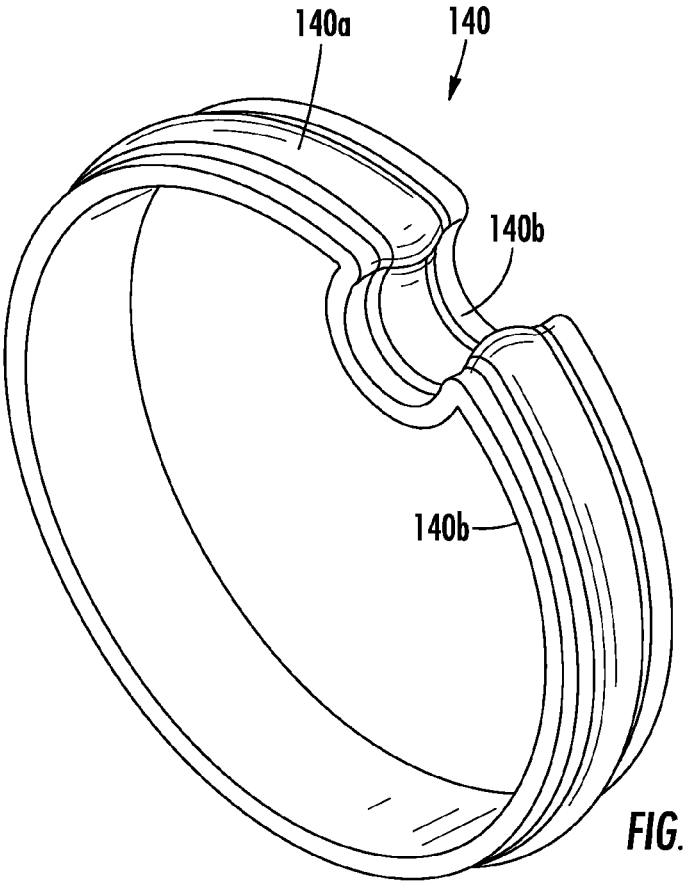

In the embodiment illustrated in FIG. 35, the elastic electrically insulating layer 140 is in the form of a cylindrical ring having an inner aperture 140*b* as shown in FIGS. 36, 38 and 39. The elastic electrically ring 140 is adapted for tight-fitting positioning within an annular slot, or recess, 142 on the outer surface of the female insulator insert 102 as shown in FIG. 37. The inner portion of the outer surface of the elastic electrically insulating ring 140 is provided with a radially, outwardly extending portion 140*a* which is adapted for tight-fitting engagement with the inner surface of the male insulator insert 132, as shown in FIG. 35. The compressible and elastic composition of the electrically insulating ring 140 allows for the use of male insulator inserts 132 having a range of inner diameters, where the range arises from manufacturing tolerances in producing the various components of the push lock connector 138. As in the case of the previously described embodiment, the elastic electrically insulating material of ring 140 is preferably comprised of a material such as silicone, a polyurethane or a low durometer epoxy, or any electrically insulating material capable of undergoing compression upon the application of an inwardly directed radial force, and is also capable of expanding outwardly to assume its original shape and size upon the removal of the radial compressive force. The thickness of the elastic electrically insulating ring 140 is also similar to the previously described elastic electrically insulating layer attached to the male insulator insert, i.e., on the order or 0.007-0.008 inch. Elastic electrically insulating ring 140 is also provided with a curvilinear recessed portion 140*c* as shown in FIGS. 38 and 39, which is adapted for tight-fitting engagement with an inwardly extending alignment rib disposed on the inner surface of female insulator insert 134. The female insulator insert's alignment rib is linearly aligned with the inwardly extending alignment rib 109 of the previously described male insulator insert 100, which is illustrated in FIGS. 28 and 31, to facilitate connection of the male and female connecting members.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An insulator insert in a push-lock electrical connector including cylindrical male and female connector members having respective plural conductive pins and conductive sockets adapted for mutual engagement in forming electrical connections and an insulator insert in said male connector member attached to said conductive pins for maintaining said conductive pins in fixed position within the connector, said insulator insert comprising:

a generally cylindrical housing having a base portion attached to said conductive pins and a peripheral, resilient, cylindrical lateral wall extending from said base portion and disposed about said conductive pins and defining an opening adapted to receive a female connector member in a tight-fitting manner, wherein said lateral wall includes at least one elongated slot therein allowing said lateral wall to move outward in a resilient manner upon the application of an outwardly directed force to said lateral wall; and an elastic electrically insulating thin layer of material disposed on an inner surface of the lateral wall of said cylindrical housing and spanning the at least one elongated slot therein to allow said lateral wall to expand radially outward to receive female connecting members having a range of outer diameters in a tight-fitting manner and provide a continuous layer of insulation about the interconnected pins and sockets.

2. The insulator insert of claim 1, wherein said cylindrical housing is comprised of plastic, or other material having high dielectric properties.

3. The insulator insert of claim 1, wherein said elastic electrically insulating material is silicone.

4. The insulator insert of claim 1, wherein said lateral wall includes first and second elongated slots disposed in opposed portions of said lateral wall to facilitate outward deflection of the opposed portions of said lateral wall, and wherein said layer of elastic insulating material spans said first and second elongated slots.

5. The insulator insert of claim 1, wherein said lateral wall includes first through fourth elongated slots equally spaced apart about the circumference of the lateral wall.

6. The insulator insert of claim 1, wherein said lateral wall includes an inwardly directed rib disposed on its inner surface to facilitate alignment of said male connector member with said female connector member when said connector members are pushed together upon connection.

7. The insulator insert of claim 6, wherein said inwardly directed rib is formed integrally with said cylindrical housing and is linear in configuration.

8. The insulator insert of claim 1, wherein said lateral wall includes at least one retaining member disposed on an inner surface thereof to engage an outer surface of the female connector member and provide secure, sealed connection thereto.

9. The insulator insert of claim 8, wherein said at least one retaining member is in the form of a generally circular ring extending about the entire inner surface of said lateral wall and formed integrally therewith.

10. The insulator insert of claim 1, wherein a distal end of said lateral wall includes a flange adapted for engaging in a sealed manner a seal disposed between and in contact with adjacent end portions of the housing's lateral wall and said female connector member.

11. The insulator insert of claim 10, wherein said seal is in the form of a compressible circular O-ring.

12. The insulator insert of claim 1, wherein said layer of elastic material has a thickness on the order of a thickness of said generally cylindrical housing.

13. The insulator insert of claim 12, wherein the thickness of said layer of said stretchable material is on the order of 0.007-0.008 inch.

14. The insulator insert of claim 1, wherein the elastic insulator material is comprised of a plastic elastomer.

15. The insulator insert of claim 1, further comprising electrically conductive particles disposed in said layer of elastic electrically insulating material to provide EMI shielding.

16. The insulator insert of claim 1, wherein said generally cylindrical housing is comprised of a plastic material such as polyurethane or a low durometer epoxy.

17. An insulator insert in a push lock electrical connector including cylindrical male and female connector members having respective plural conductive pins and conductive sockets adapted for mutual engagement in forming electrical connections, and an insulator insert in said female connector member attached to said conductive sockets for maintaining said conductive sockets in fixed position within the connector, said insulator insert comprising:

a generally cylindrical housing including a base portion attached to said conductive sockets and a peripheral cylindrical outer wall having an annular outer recessed slot extending about said cylindrical outer wall;

a generally circular continuous seal member disposed on and about the peripheral outer wall of said cylindrical housing and extending outwardly from said outer wall, wherein said seal member is adapted to receive about its outer periphery the generally cylindrical male connector member in tight-fitting engagement to securely connect the male and female connector members together in a sealed manner; and a thin layer of an electrically insulating elastic material disposed on said circular seal member about its entire periphery and adapted to receive and engage about its generally circular outer periphery a male connecting member, wherein said male connecting member has an inner diameter which may vary over a range of values, and wherein the housing's peripheral outer wall and said elastic material layer are adapted to reduce in diameter to accommodate the range of male connecting member inner diameters while maintaining a continuous layer of said electrically insulating material about the connector's pins and sockets.

18. The insulator insert of claim 17, wherein said elastic electrically insulating material is silicone, polyurethane or an elastic epoxy.

19. The insulator insert of claim 17, wherein said generally cylindrical housing is comprised of plastic, or other material with high dielectric properties.

20. The insulator insert of claim 17, wherein said cylindrical housing includes a generally linear inward directed recessed portion on its outer surface to facilitate alignment of said female connector member with said male connector member when said connector members are pushed together to form an electrical connection.

21. The insulator insert of claim 20, wherein said generally linear recessed portion is formed integrally with said cylindrical housing.

22. The insulator insert of claim 17, wherein said male connector member has an outer lateral wall, and wherein said layer of elastic material has a thickness on the order of the thickness of the outer lateral wall of said male connector member.

23. The insulator insert of claim 22, wherein the thickness of the layer of elastic material is on the order of 0.007-0.008 inch.

24. The insulator insert of claim 17, wherein said elastic electrically insulating material is comprised of a plastic elastometer.

25. The insulator insert of claim 17 further comprising electrically conductive particles disposed in said thin layer of elastic electrically insulating plastic material to provide electromagnetic interference (EMI) shielding.

26. The insulator insert of claim 17, wherein said generally cylindrical housing is comprised of a plastic material such as polyurethane or a low durometer epoxy.

27. An insulator insert in a push lock electrical connector having cylindrical male and female connector members respectfully having plural conductive pins and conductive sockets adapted for mutual engagement in forming electrical connections, a connection arrangement for allowing a male connector member to receive female connectors having a range of outer diameters or for allowing a female connector member to receive male connectors having a range of inner diameters, said connection arrangement comprising:

a first generally cylindrical housing of said male connector member and a second generally cylindrical housing of said female connector member, wherein said first cylindrical housing of the male connector member includes a generally cylindrical wall extending from a first end of said first cylindrical housing and defining an open end within which are disposed the conductive pins and wherein said open end is adapted to receive in a tight-fitting manner a first end of said female connector member bearing said conductive sockets;

first means disposed in said cylindrical wall for allowing said cylindrical wall to expand radially outward to accommodate a female connector member of larger diameter, or second means disposed in or on an outer surface of said female connector member to allow said female connector member to contract radially inward to accommodate a male connector member of reduced diameter; and a thin layer of elastic electrically insulating material disposed on either an inner surface of the male connecting member's cylindrical wall or the female member's outer surface to respectively allow said cylindrical wall to expand radially outward or the outer surface of said female connector member to contract radially inward to accommodate the insertion of a larger female connector member into a male connector member or a smaller male connector member onto a female connector member while providing a continuous layer of said elastic electrically insulating material disposed about said pins and sockets.

* * * * *